US007574986B2

(12) United States Patent
Ishikawa et al.

(10) Patent No.: US 7,574,986 B2
(45) **Date of Patent: *Aug. 18, 2009**

(54) VARIABLE COMPRESSION RATIO DEVICE OF INTERNAL COMBUSTION ENGINE

(75) Inventors: Seiichiro Ishikawa, Wako (JP); Kazuo Yoshida, Wako (JP); Takashi Kondo, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 233 days.

This patent is subject to a terminal disclaimer.

(21) Appl. No.: 11/645,644

(22) Filed: Dec. 27, 2006

(65) Prior Publication Data

US 2007/0175421 A1 Aug. 2, 2007

(30) Foreign Application Priority Data

Dec. 28, 2005 (JP) ..... 2005-379086
Dec. 1, 2006 (JP) ..... 2006-326343

(51) Int. Cl.
*F02B 75/04* (2006.01)
*F02D 15/02* (2006.01)

(52) U.S. Cl. ..... 123/78 BA; 91/505

(58) Field of Classification Search ..... 123/48 R, 123/48 A, 48 AA, 48 B, 78 R, 78 A, 78 AA, 123/78 BA, 78 B
See application file for complete search history.

(56) References Cited

U.S. PATENT DOCUMENTS 2,742,027 A * 4/1956 Mansfield ..... 123/78 R
3,405,697 A * 10/1968 Marchand ..... 123/78 R
3,777,724 A * 12/1973 Kiley ..... 123/78 B
4,016,841 A * 4/1977 Karaba et al. ..... 123/78 B
4,031,868 A * 6/1977 Karaba et al. ..... 123/78 B
4,079,707 A * 3/1978 Karaba et al. ..... 123/78 B
4,241,705 A * 12/1980 Karaba et al. ..... 123/78 B
4,463,710 A * 8/1984 McWhorter ..... 123/48 B
4,515,114 A * 5/1985 Dang ..... 123/48 B
4,784,093 A * 11/1988 Pfeffer et al. ..... 123/78 B
4,785,790 A * 11/1988 Pfeffer et al. ..... 123/78 B
4,809,650 A * 3/1989 Arai et al. ..... 123/78 B
4,864,977 A * 9/1989 Hasegawa ..... 123/48 B
4,934,347 A * 6/1990 Suga et al. ..... 123/78 B
5,178,103 A * 1/1993 Simko ..... 123/48 B
5,179,916 A * 1/1993 Schonfeld ..... 123/48 B (Continued)

FOREIGN PATENT DOCUMENTS

JP 2004-44512 A 2/2004

*Primary Examiner*—Michael Cuff
*Assistant Examiner*—Hung Q Nguyen
(74) *Attorney, Agent, or Firm*—Birch, Stewart, Kolasch & Birch, LLP

(57) ABSTRACT

A variable compression ratio device includes a piston having a piston inner part and a piston outer part. The piston outer part integrally includes ear parts facing opposite ends of a piston pin and having long holes with longer diameters directed in an axial direction of a piston. A shaft portion connected to the opposite ends of the piston pin is slidably fitted in the long holes to allow an axial relative movement between the piston inner part and the piston outer part, while preventing relative rotation between the piston inner part and the piston outer part. Thus, the variable compression ratio device reliably prevents the relative rotation between the piston inner part and the piston outer part with a simple structure, and reduces weight of the piston.

17 Claims, 23 Drawing Sheets

U.S. PATENT DOCUMENTS 5,257,600 A * 11/1993 Schechter et al. ..... 123/78 B
5,331,928 A * 7/1994 Wood ..... 123/78 B
5,476,074 A * 12/1995 Boggs et al. ..... 123/48 B
5,755,192 A * 5/1998 Brevick ..... 123/78 B
6,209,510 B1 * 4/2001 Brogdon et al. ..... 123/197.4
7,377,238 B2 * 5/2008 Ishikawa et al. ..... 123/43 R
2004/0231619 A1 * 11/2004 Hirano ..... 123/48 B
2005/0056239 A1 * 3/2005 Hirano ..... 123/48 B
2007/0175420 A1 * 8/2007 Ishikawa et al. ..... 123/78 BA

* cited by examiner

LOW COMPRESSION RATIO

LOW COMPRESSION RATIO

LOW COMPRESSION RATIO

LOW COMPRESSION RATIO

HIGH COMPRESSION RATIO

HIGH COMPRESSION RATIO

HIGH COMPRESSION RATIO

HIGH COMPRESSION RATIO

LOW COMPRESSION RATIO

HIGH COMPRESSION RATIO

LOW COMPRESSION RATIO

HIGH COMPRESSION RATIO

HIGH COMPRESSION RATIO

HIGH COMPRESSION RATIO

HIGH COMPRESSION RATIO

VARIABLE COMPRESSION RATIO DEVICE OF INTERNAL COMBUSTION ENGINE

CROSS-REFERENCE TO RELATED APPLICATION

The present application claims priority under 35 USC 119 to Japanese Patent Application Nos. 2005-379086 filed on Dec. 28, 2005 and 2006-326343 filed on Dec. 1, 2006 the entire contents of which are hereby incorporated by reference.

BACKGROUND OF THE INVENTION

1. Field of the Invention

The present invention relates to an improvement of a variable compression ratio device of an internal combustion engine, comprising: a piston including a piston inner part connected to a connecting rod via a piston pin, and a piston outer part which is fitted on an outer periphery of the piston inner part so as to be only slidable in an axial direction and which is movable between a low compression ratio position near the piston inner part and a high compression ratio position near a combustion chamber, with an outer end surface of the piston outer part facing the combustion chamber, the piston inner part being provided with a piston outer part holding device that selectively holds the piston outer part in the low compression ratio position and the high compression ratio position.

2. Description of the Related Art

Japanese Patent Application Laid-open No. 2004-44512 discloses a variable compression ratio device of an internal combustion engine.

SUMMARY OF THE INVENTION

In the conventional variable compression ratio device of an internal combustion engine, a piston outer part is moved between a low compression ratio position and a high compression ratio position, thus is movable in an axial direction relative to a piston inner part connected to a piston pin, but is non-rotatable in order to avoid interference between the piston outer part and intake and exhaust valves, or the like. In order to prevent rotation of the piston outer part, the piston inner part and the piston outer part are slidably splined to each other in the conventional device. Particularly, a spline-forming portion along the entire circumference of the piston outer part needs to be relatively thick, leading to an increase in weight of the piston.

The present invention has been achieved in view of such circumstances, and has an object to provide a variable compression ratio device of an internal combustion engine that can reliably prevent relative rotation between a piston inner part and a piston outer part with a simple structure, and reduces weight of a piston.

In order to achieve the above object, according to a first feature of the present invention, there is provided a variable compression ratio device of an internal combustion engine, comprising: a piston including a piston inner part connected to a connecting rod via a piston pin, and a piston outer part which is fitted on an outer periphery of the piston inner part so as to be only slidable in an axial direction and which is movable between a low compression ratio position near the piston inner part and a high compression ratio position near a combustion chamber, with an outer end surface of the piston outer part facing the combustion chamber, the piston inner part being provided with a piston outer part holding device that selectively holds the piston outer part in the low compression ratio position and the high compression ratio position, wherein long holes with longer diameters directed in an axial direction of the piston are provided in the piston outer part to face opposite ends of the piston pin; and a shaft portion connected to the opposite ends of the piston pin is slidably fitted in the long holes to allow an axial relative movement between the piston inner part and the piston outer part while preventing relative rotation between the piston inner part and the piston outer part.

The piston outer part holding device corresponds to a cam mechanism 37 and a lock mechanism 40 in embodiments of the present invention described later, and the shaft portion corresponds to an extension shaft 15.

With the first feature of the present invention, an extremely simple structure in which the shaft portion connected to opposite ends of the piston pin is slidably fitted in the long holes in the piston outer part allows the axial relative movement between the piston inner part and the piston outer part while reliably preventing the relative rotation therebetween. Also, the piston outer part has a sufficient strength simply by thickening its portions in which the long holes are formed, thereby reducing the weight of the piston.

According to a second feature of the present invention, in addition to the first feature, the shaft portion is abutted against lower end walls of the long holes to establish a movement limit of the piston outer part toward the high compression ratio position H.

With the second feature of the present invention, the movement limit of the piston outer part toward the high compression ratio position can be established without using any special stopper member, thereby contributing to simplification of the structure of the device. Further, a shock provided when the piston outer part is stopped at the movement limit in the direction to the high compression ratio position is transferred from the piston outer part directly to the piston pin through the lower end walls of the long holes and the shaft portion that abut against each other, and not transferred to the piston inner part. This prevents the shock from affecting the piston outer part holding device provided in the piston inner part.

According to a third feature of the present invention, in addition to the first or second feature, the long holes are provided in a pair of ear parts extending from a peripheral wall of the piston outer part that receives piston rings so as to face the opposite ends of the piston pin; and a skirt portion slidably guided by an inner peripheral surface of a cylinder bore is formed integrally with the piston inner part and away from the ear parts.

With the third feature of the present invention, the skirt portion is formed in the piston inner part away from the ear parts, and thus the need for forming a skirt portion in the piston outer part is eliminated, thereby significantly reducing overlapping portions of the piston inner part and the piston outer part to significantly reduce the weight of the piston.

According to a fourth feature of the present invention, in addition to the first or second feature, an inner slide flat surface extending in an axial direction of the piston is formed in an outer peripheral surface of the piston inner part; and an outer slide flat surface against which the inner slide flat surface slidably abuts is formed in an inner peripheral surface of the piston outer part.

With the fourth feature of the present invention, the relative rotation between the piston inner part and the piston outer part can be reliably prevented by the fitting between the long holes and the shaft portion, and the abutment between the inner slide flat surface of the piston inner part and the outer slide flat surface of the piston outer part, with a simple structure.

According to a fifth feature of the present invention, in addition to the third feature, inner slide flat surfaces extending in an axial direction of the piston are formed in opposite sides of the outer peripheral surface of the piston inner part that face the opposite ends of the piston pin; and outer slide flat surfaces against which the inner slide flat surfaces slidably abut are formed in inner surfaces of the ear parts.

With the fifth feature of the present invention, the ear parts of the piston outer part can be used to further reliably prevent the relative rotation between the piston inner part and the piston outer part, with a simple structure.

According to a sixth feature of the present invention, in addition to the second feature, a shock absorber that absorbs an abutment shock of the shaft portion abutting against the lower end walls of the long holes is provided between the shaft portion and the piston inner part.

With the sixth feature of the present invention, during the movement of the piston outer part to the high compression ratio position, the piston outer part can be reliably controlled to the high compression ratio position while the abutment shock of the shaft portion abutting against the lower end walls of the long holes is absorbed by the operation of the shock absorber.

According to a seventh feature of the present invention, in addition to any one of the first to sixth features, the piston outer part holding device includes a lift member that is rotatably supported by and coaxially with the piston inner part and is rotatable between a lift release position in which the piston outer part is movable to the low compression ratio position, and a lift position in which the piston outer part is held in the high compression ratio position.

With the seventh feature of the present invention, the relative rotation between the piston inner part and the piston outer part is reliably prevented, and also the rotation of the lift member is reliably performed, thereby precisely controlling the piston outer part to the low compression ratio position or the high compression ratio position.

According to an eighth feature of the present invention, in addition to the second or third feature, an escape is provided in an inner end of the lower end wall of each long hole on the side of the center of the piston outer part, the escape preventing the shaft portion from coming into contact with an inner end corner of the lower end wall on the side of the center of the piston outer part when the shaft portion is bent by an abutment shock against the lower end wall.

When the piston outer part is moved from the low compression ratio position to the high compression ratio position by a separating force generated between the piston inner part and the piston outer part, particularly during a high speed operation of the internal combustion engine, the shaft portion supported by the piston inner part is moved down in the long holes in the piston outer part to abut against the lower end walls of the long holes with a shock, which may cause an end of the shaft portion to be elastically bent upward. With the eighth feature of the present invention, however, the escape is provided in the inner end of the lower end wall of each long hole on the side of the center of the piston outer part so as to prevent the bent shaft portion from coming into contact with the corner of the lower end wall of each long hole on the side of the center of the piston outer part, thereby preventing damage to the corner. Also, at this time, the bent shaft portion strongly abuts against an intermediate portion of the lower end wall of the long hole, but outward bending moment applied to a side wall or the ear part of the piston outer part by a load applied to an intermediate portion of the lower end wall is relatively small, thereby preventing damage to the side wall or the ear part, and contributing to an improvement in durability of the piston outer part.

According to a ninth feature of the present invention, in addition to the eighth feature, the lower end wall of each long hole comprises a semicylindrical wall that has one end connected to an outer peripheral surface of the piston outer part and corresponds to a half of a peripheral surface of the shaft portion, and a semi-conical wall that extends from the other end of the semicylindrical wall to an inner peripheral surface of the piston outer part and has a diameter increasing toward the inner peripheral surface; and the semi-conical wall forms the escape.

With the ninth feature of the present invention, when the piston outer part is moved from the low compression ratio position to the high compression ratio position by an axial separating force generated between the piston inner part and the piston outer part during a low or middle speed operation of the internal combustion engine, the separating force is relatively small, and thus an abutment shock force applied to the lower end walls of the long holes by the shaft portion is relatively small. Therefore, the shaft portion is supported by large pressure receiving areas of the semicylindrical walls of the lower end walls of the long holes substantially without being bent, thereby securing wear part resistance thereof. Further, the semi-conical wall that forms the escape is placed only in the lower end wall of each long hole, which does not reduce strength of a root of the ear part.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figure 1:
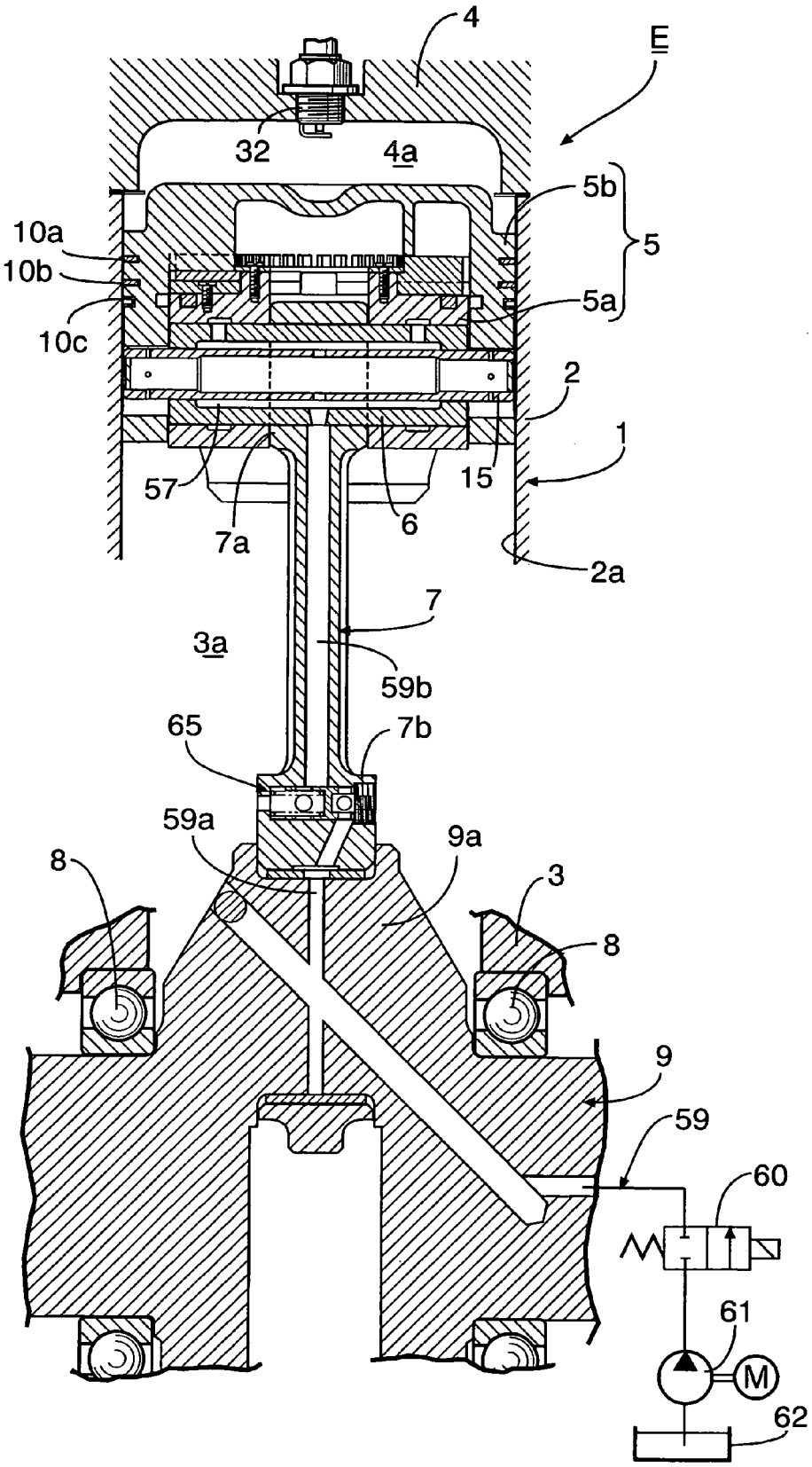
FIG. 1 is a vertical sectional front view of a main part of an internal combustion engine including a variable compression ratio device according to a first embodiment of the present invention.

A first embodiment of the present invention will be described with reference to FIGS. 1 to 18. In FIGS. 1 and 5, an engine body 1 of an internal combustion engine E includes a cylinder block 2 having a cylinder bore 2*a*, a crankcase 3 which is connected to a lower end of the cylinder block 2 and a cylinder head 4 which has a pent roof type combustion chamber 4*a* connected to an upper end of the cylinder bore 2*a* and which is connected to an upper end of the cylinder block 2. Threadedly fitted to the cylinder head 4 are an intake valve 31*i* and an exhaust valve 31*e* that open and close an intake port 30*i* and an exhaust port 30*e* which are opened in a ceiling surface of the combustion chamber 4*a*. An ignition plug 32 with electrodes is provided that faces a central portion of the combustion chamber 4*a*.

A small end portion 7*a* of a connecting rod 7 is connected via a piston pin 6 to a piston 5 which is slidably fitted in the cylinder bore 2*a*. A large end portion 7*b* of the connecting rod 7 is connected via a pair of left and right bearings 8 to a crank pin 9*a* of a crankshaft 9 which is rotatably supported in the crankcase 3.

As shown in FIGS. 2 to 5, the piston 5 includes a piston inner part 5*a* which is connected to the small end portion 7*a* of the connecting rod 7 via the piston pin 6 and a piston outer 5*b* which is slidably fitted to an outer peripheral surface of the piston inner part 5*a* and has its top surface facing the combustion chamber 4*a*. A plurality of piston rings 10*a* to 10*c* are attached to an outer periphery of the piston outer part 5*b* so as to be slidable in close contact with an inner peripheral surface of the cylinder bore 2*a*.

A pair of pin boss parts 11 and a pair of arc-shaped skirt parts 12 are integrally formed at the piston inner part 5*a*. The pin boss parts 11 support opposite end portions of the piston pin 6. The skirt parts 12 are slidably fitted to the inner peripheral surface of the cylinder bore 2*a* except for the portions corresponding to outer ends of the pin boss parts 11. The piston pin 6 is formed to be hollow.

In the piston outer part 5*b*, a peripheral wall to which the piston rings 10*a* to 10*c* are fitted is terminated at the positions opposed to the upper end surfaces 12*a* of the skirt parts 12. A pair of ear parts 13 opposed to the outer ends of both the pin boss parts 11 are integrally formed at the piston outer part 5*b*. They are provided with long holes 14 having longer diameters in the axial direction of the piston 5. An extension shaft 15 penetrate through the hollow part of the piston pin 6, with its opposite end portion being fitted into the long holes 14 to be slidable in the axial direction of the piston 5, and is fixed to the piston pin 6 by press-fitting or the like. Thus, the fitting between the long holes 14 and the extension shaft 15 allows relative slide therebetween in the axial direction while inhibiting relative rotation therebetween. The extension shaft 15 abutting on the lower surfaces of the long holes 14 defines the downward slide limit of the piston inner part 5*a* with respect to the piston outer part 5*b*.

A pair of inner slide flat surfaces 23 extending in the axial direction of the piston pin 5 are formed at opposite side portions, facing the opposite end surfaces of the piston pin 6, of the outer peripheral surface of the piston inner part 5*a*. Outer slide flat surfaces 24 which slidably abut on the inner slide flat surface 23 are formed on inner surfaces of the ear parts 13 of the piston outer part 5*b*. These slide flat surfaces 23 and 24 also allow relative sliding in the axial direction between the piston inner part 5*a* and the piston outer part 5*b* while inhibiting the relative rotation therebetween. Accordingly, the relative rotation between the piston inner part 5*a* and the piston outer part 5*b* can be firmly inhibited by the fitting between the long holes 14 and the extension shaft 15 and abutment between the inner and outer slide flat surfaces 23 and 24. Use of both the fitting structure between the long holes 14 and the extension shaft 15 and the abutment structure between the inner and outer slide flat surfaces 23 and 24 for prevention of the relative rotation of the piston inner part 5*a* and the piston outer part 5*b* reduces the load acting on each structure, thereby effectively enhancing friction resistance and rigidity for prevention of rotation of the piston inner part 5*a* and the piston outer part 5*b*. However, depending on the required specifications, only one of these structures can be used.

Figure 2:
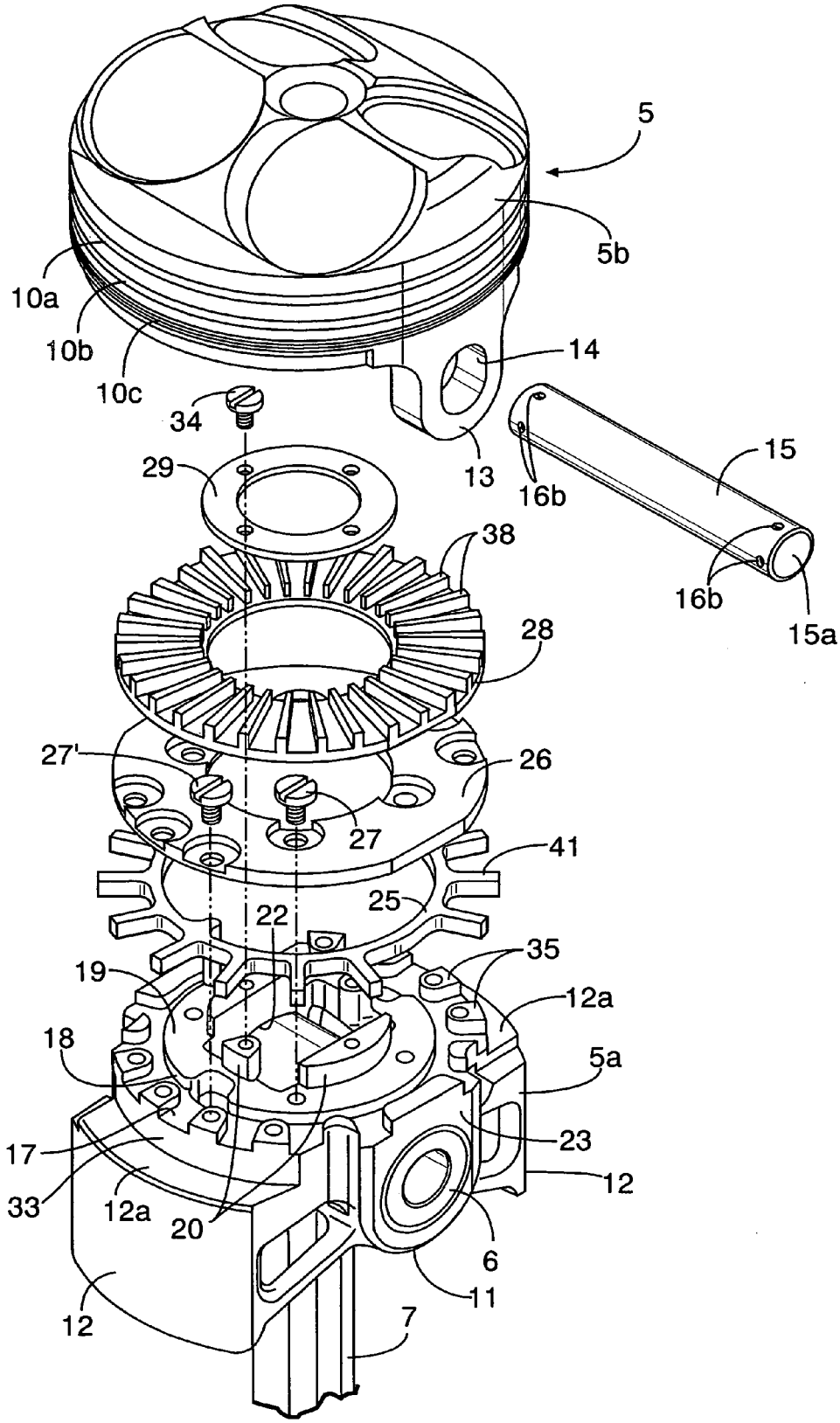
FIG. 2 is an exploded perspective view taken from above the variable compression ratio device.
Figure 3:
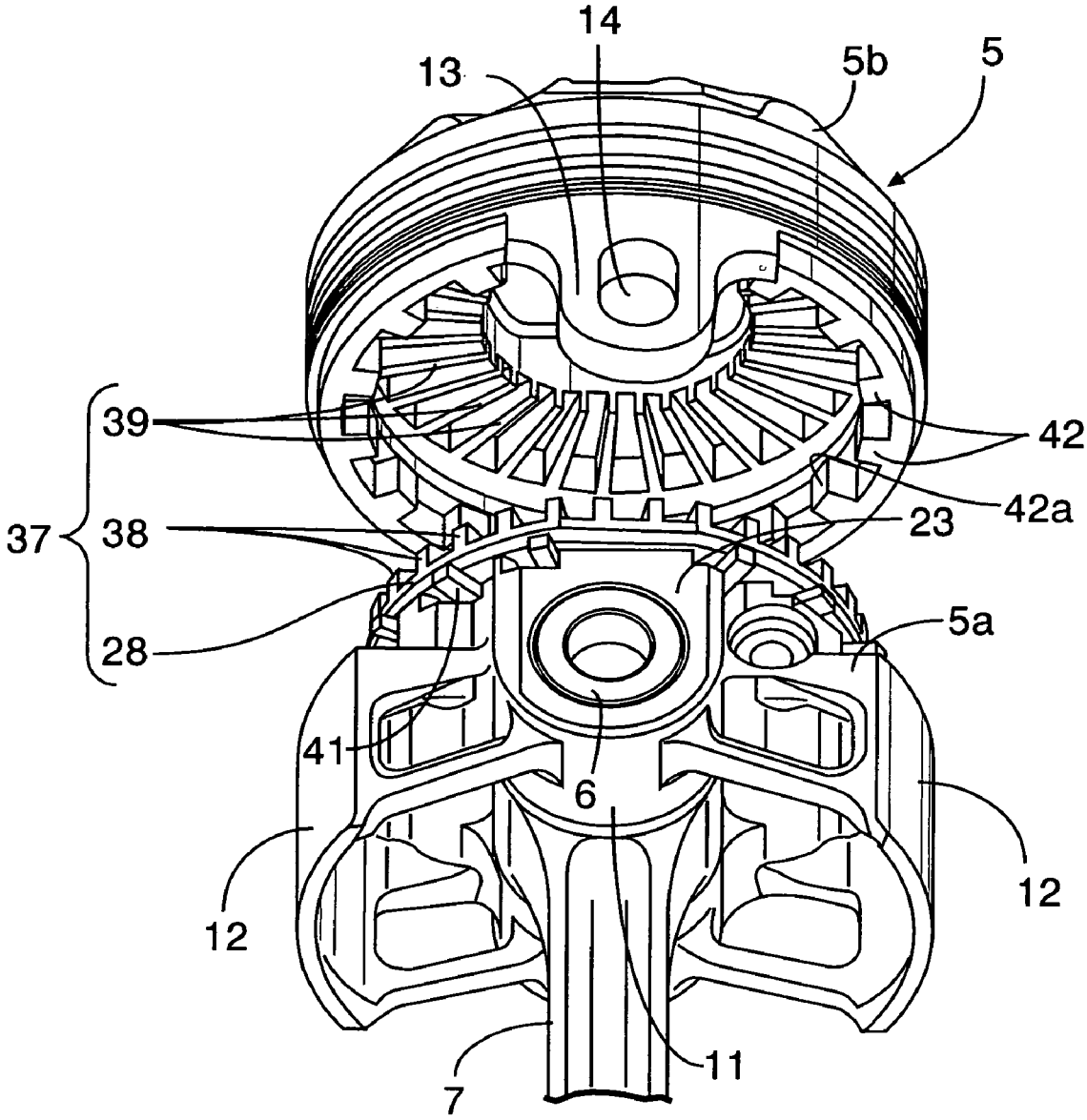
FIG. 3 is an exploded perspective view taken from below the variable compression ratio device.

In FIGS. 2, 3 and 5, the piston inner part 5*a* and the piston outer part 5*b* obtain a sufficient relative slide support length in the axial direction by virtue of the slidable fitting between the extension shaft 15 and the long holes 14 and slidable fitting between a pair of arc surfaces 33 on the outer periphery of the piston inner part 5*a* and an inner peripheral surface 42*a* of a female spline 42 of the piston outer part 5*b*, thereby securing stable relative sliding in the axial direction. The arc surfaces 33 are vertically formed to connect upper end surfaces 12*a* of a pair of skirt parts 12 and first support surfaces 17.

Figure 4:
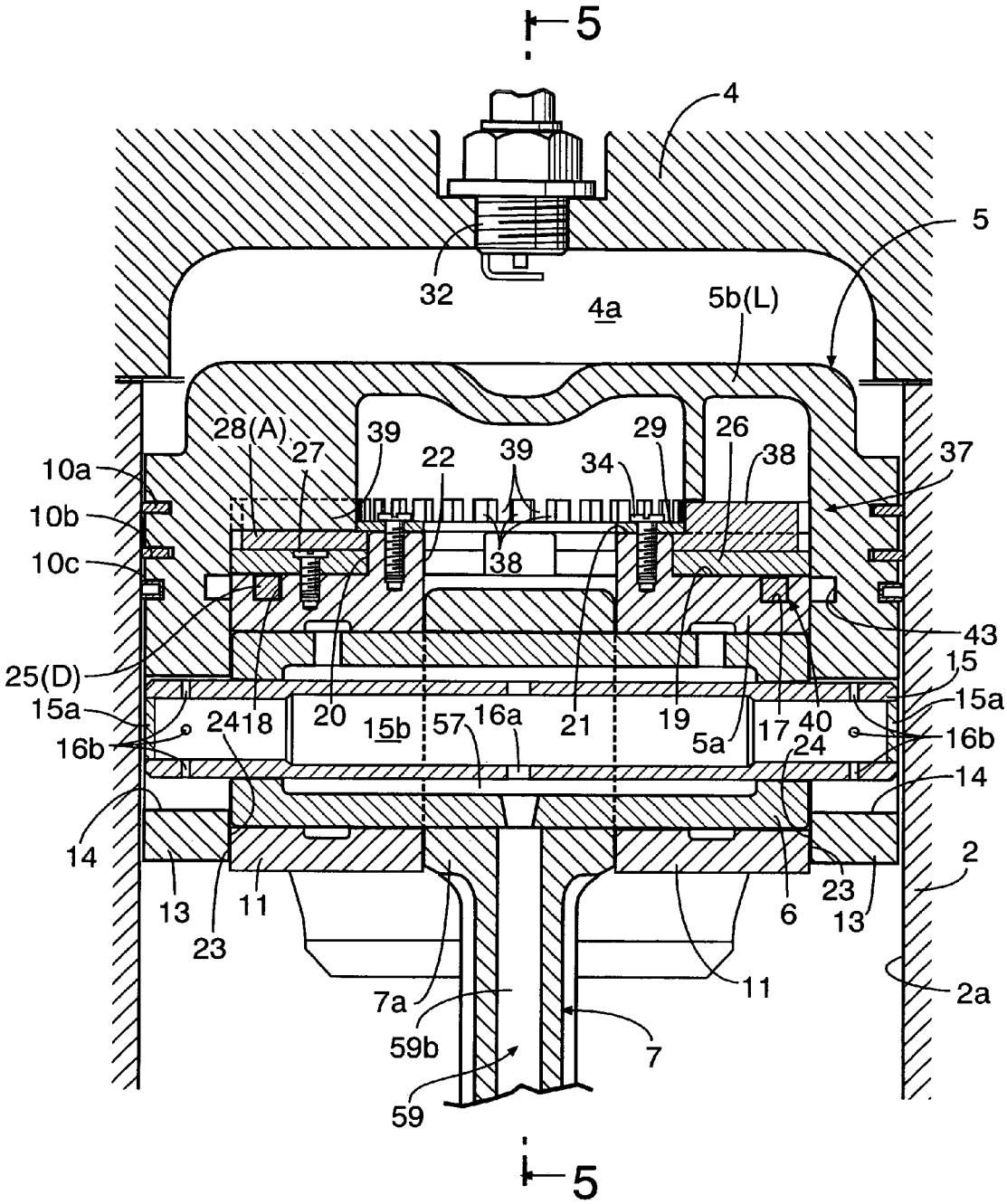
FIG. 4 is an enlarged view of the main part (low compression ratio state) in FIG. 1.
Figure 5:
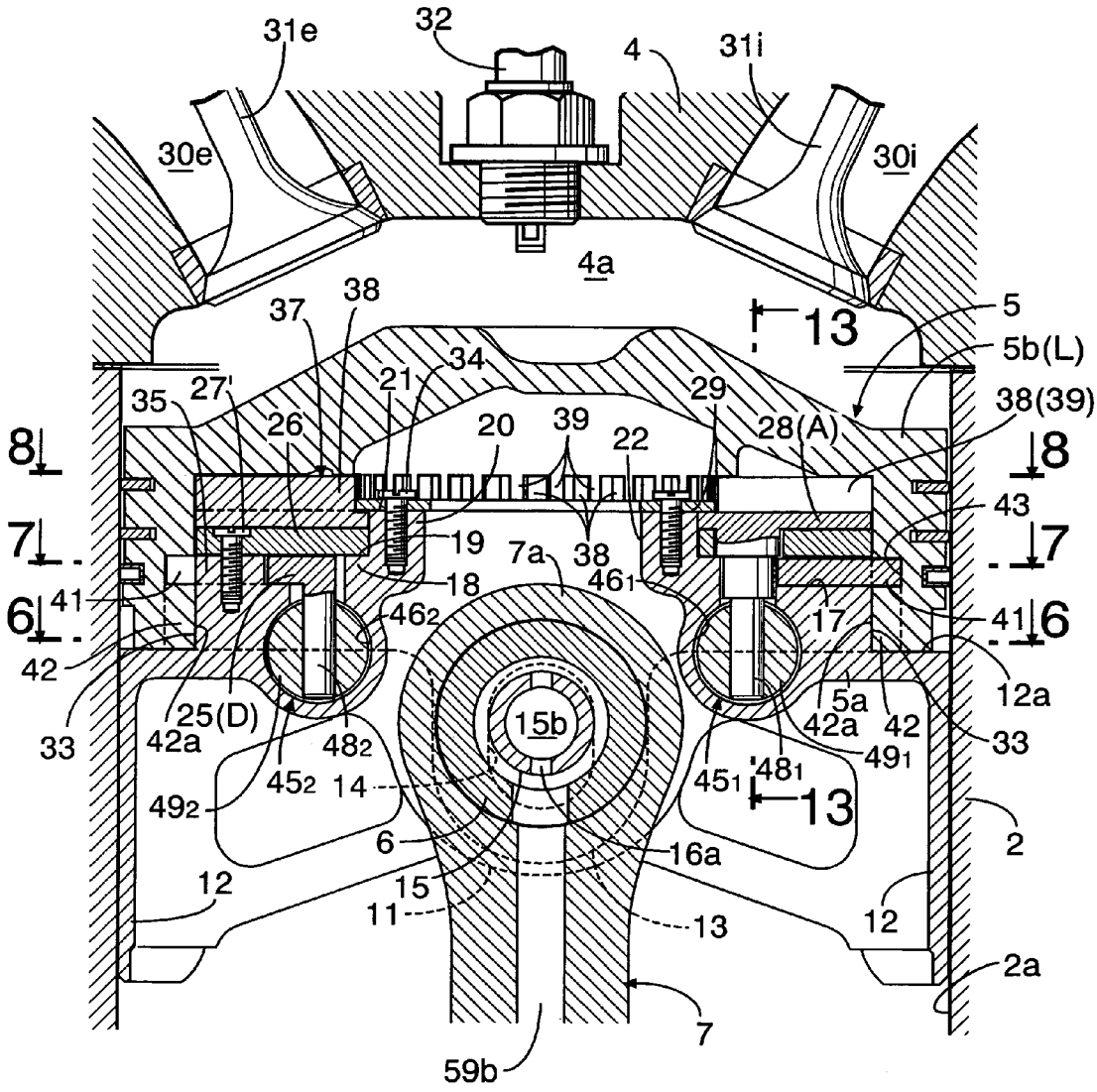
FIG. 5 is a sectional view taken on line 5-5 in FIG. 4.

As clearly shown in FIGS. 3 to 5, a circular first support surface 17 facing up, a first pivotal shaft 18 rising from an inner peripheral edge of the first support surface 17, a circular second support surface 19 which is formed at an upper end of the first pivotal shaft 18, a second pivotal shaft 20 rising from an inner peripheral edge of the second support surface 19, and a circular third support surface 21 which is formed at an upper end surface of the second pivotal shaft 20 are formed at the upper portion of the piston inner part 5*a* coaxially with the piston inner part 5*a* and sequentially from its outer peripheral side. The second pivotal shaft 20 is divided into a plurality of blocks along its circumferential direction in order to reduce its weight. An opening 22 facing the small end portion 7*a* of the connecting rod 7 is provided in a central portion of the second pivotal shaft 20. Scattered lubricating oil generated in the crankcase 3, that is, the crank chamber 3*a* passes through the opening 22.

An annular lock plate 25, which is mounted on the first support surface 17, is rotatably fitted on the first pivotal shaft 18. An annular first holding plate 26, which is fitted on the second pivotal shaft 20 to be opposed to the top surface of the lock plate 25, is fixed to the second support surface 19 with a plurality of screws 27. An annular lift member 28 which is mounted on the first holding plate 26 is rotatably fitted on the second pivotal shaft 20. A second holding plate 29 opposed to the top surface of an inner peripheral edge portion of the lift member 28 is fixed to the third support surface 21 with a plurality of screws 34.

The lift member 28 is capable of reciprocally rotating between a lift position B and a lift release position A which are set around the second pivotal shaft 20. The lift member 28 forms a main part of a cam mechanism 37 which alternately holds the piston outer part 5*b* in a low compression ratio position L (see FIGS. 4 and 5) near the piston inner part 5*a* and in a high compression ratio position H (see FIGS. 9 and 10) near the combustion chamber 4*a*, with its reciprocal rotation.

Figure 8:
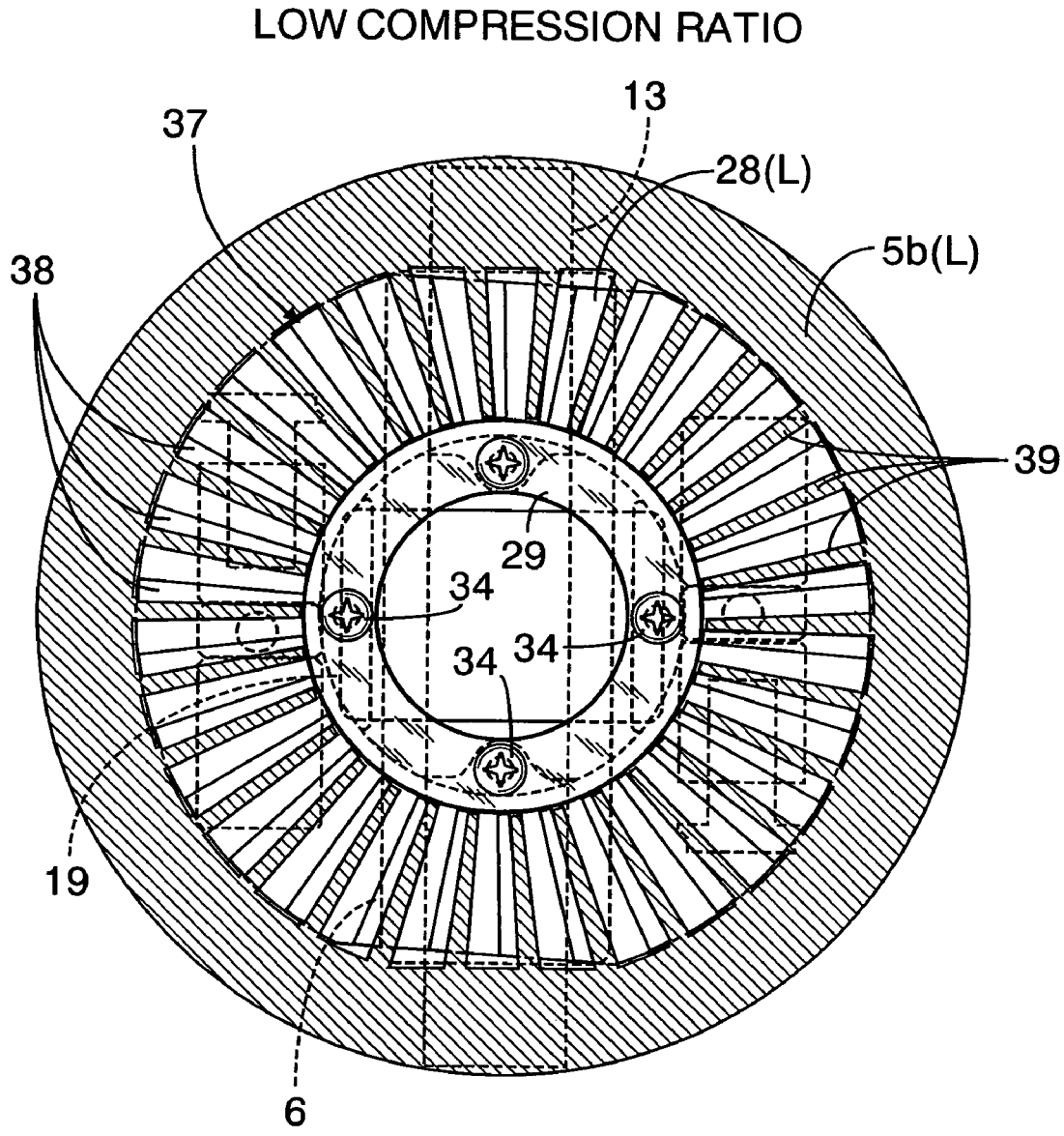
FIG. 8 is a sectional view taken on line 8-8 in FIG. 5.

More specifically, as shown in FIGS. 4, 5 and 8, the cam mechanism 37 includes the lift member 28, a plurality of first cam top portions 38 in a circular arrangement which are integrally projectingly provided on a top surface of the lift member 28 and second cam top portions 39 in a circular arrangement which are projectingly provided on an undersurface of a head part of the piston outer part 5*b*. In each of the cam top portions 38 and 39, its top surface is flat and opposite side surfaces, which are arranged in an arranging direction of each of the cam top portions 38 and 39, are formed to be rectangular in section that are vertical surfaces with respect to its top surface.

Thus, when the lift member 28 is in the lift release position A, the upper second cam top portions 39 are capable of entering and leaving bottom portions between the first cam top portions 38 of the member 28 (see FIG. 13), thereby allowing a shift of the piston outer part 5*b* to the low compression ratio position L or the high compression ratio position H. When the first and the second cam top portions 38 and 39 are meshed with each other, and the top surface of at least one of the cam top portions abuts on the bottom of the bottom portion between the other cam top portions, the cam mechanism 37 enters the axially contracted state to bring the piston outer part 5*b* into the low compression ratio position L.

When the lift member 28 is in the lift position B, the flat top surfaces of the first and the second cam top portions 38 and 39 abut against each other (see FIG. 14) so that the cam mechanism 37 enters the axially extended state, thereby bringing the piston outer part 5*b* into the high compression ratio position H. At this time, the extension shaft 15 which is fixed to the piston pin 6 as described above abuts on the lower surfaces of the long holes 14 of the ear parts 13 in the piston outer part 5*b*, thereby preventing the piston outer part 5*b* from exceeding the predetermined high compression ratio position H to move to the combustion chamber 4*a* side.

Figure 7:
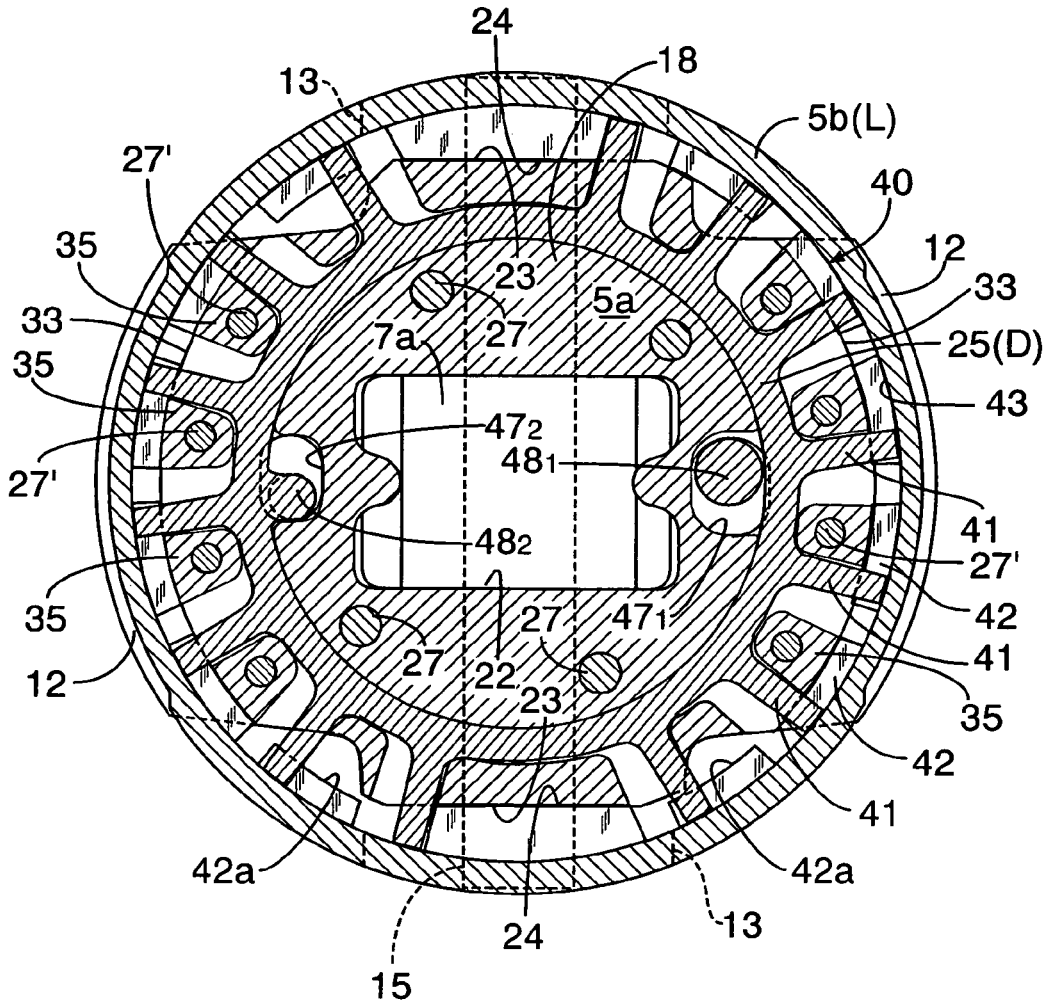
FIG. 7 is a sectional view taken on line 7-7 in FIG. 5.

As shown in FIGS. 4, 5 and 7, the lock plate 25 is capable of reciprocally rotating between a lock release position C (see FIG. 12) and a lock position D (see FIG. 7) which are set around the first pivotal shaft 18. The lock plate 25 forms a main part of a lock mechanism 40 which maintains the axially contracted state of the cam mechanism 37 in its lock position D.

More specifically, the lock mechanism 40 includes the lock plate 25, a male spline 41 which is formed on an outer periphery of the lock plate 25, the female spline 42 which is formed on an inner periphery of the piston outer part 5*b* for the male spline 41 to be slidably fitted therein and an annular lock groove 43 which provides communication between upper end portions of groove portions of the female spline 42 to allow rotation and entry of tooth portions of the male spline 41. When switching the position of the piston outer part 5*b* between the low compression ratio position L and the high compression ratio position H, the lock mechanism 40 sets the lock plate 25 at the lock release position C to bring the male spline 41 into a sliding relationship with the female spline 42. When the piston outer part 5*b* comes to the low compression ratio position L, the lock mechanism 40 rotates the lock plate 25 to the lock position D to allow the tooth portion of the male spline 41 to enter the lock groove 43 so that the end surfaces of the tooth portion of the male spline 41 and the tooth portion of the female spline 42 abut against each other, whereby the low compression ratio position L of the piston outer part 5*b* is locked.

Figure 10:
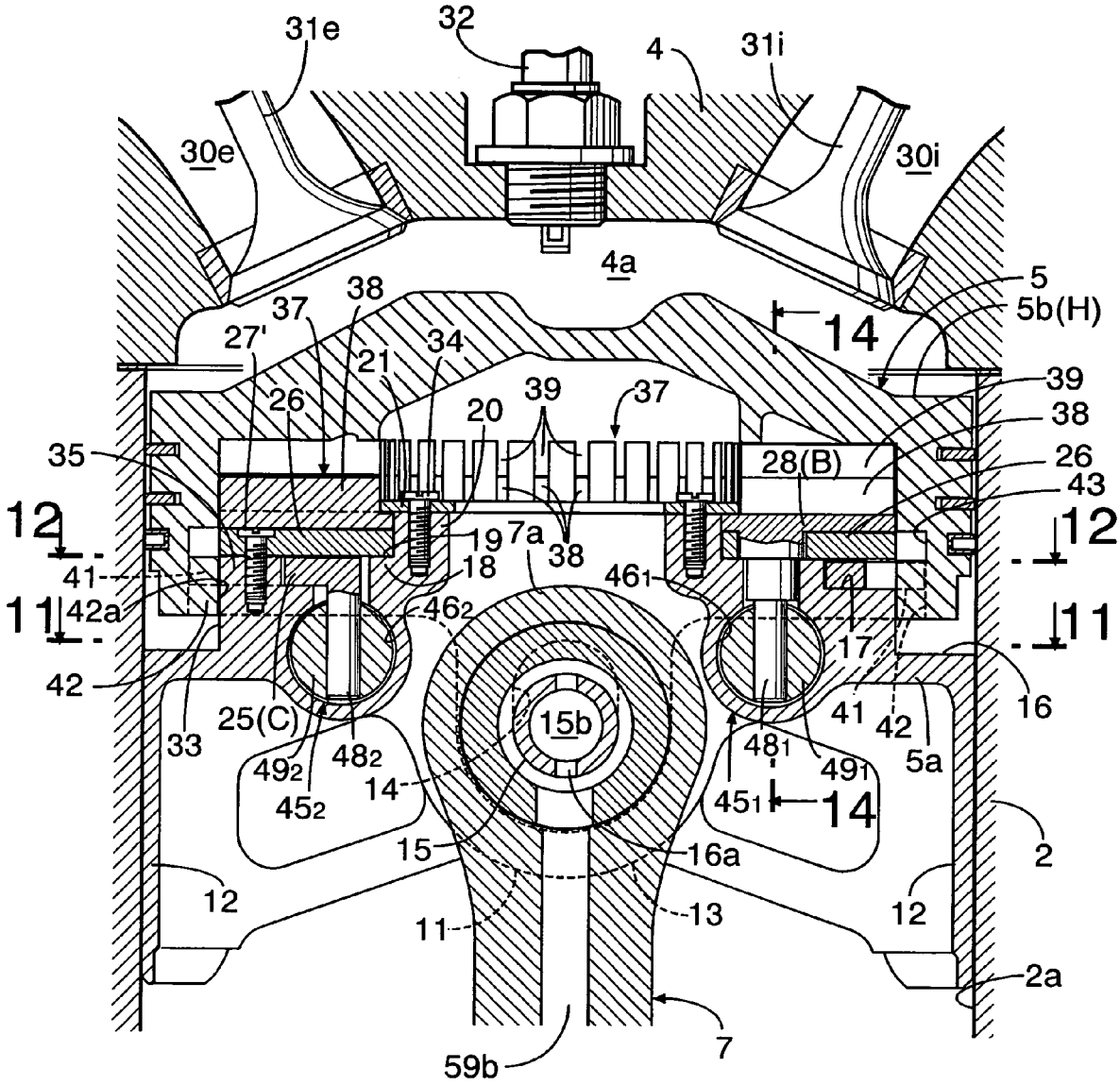
FIG. 10 is a sectional view taken on line 10-10 in FIG. 9.
Figure 11:
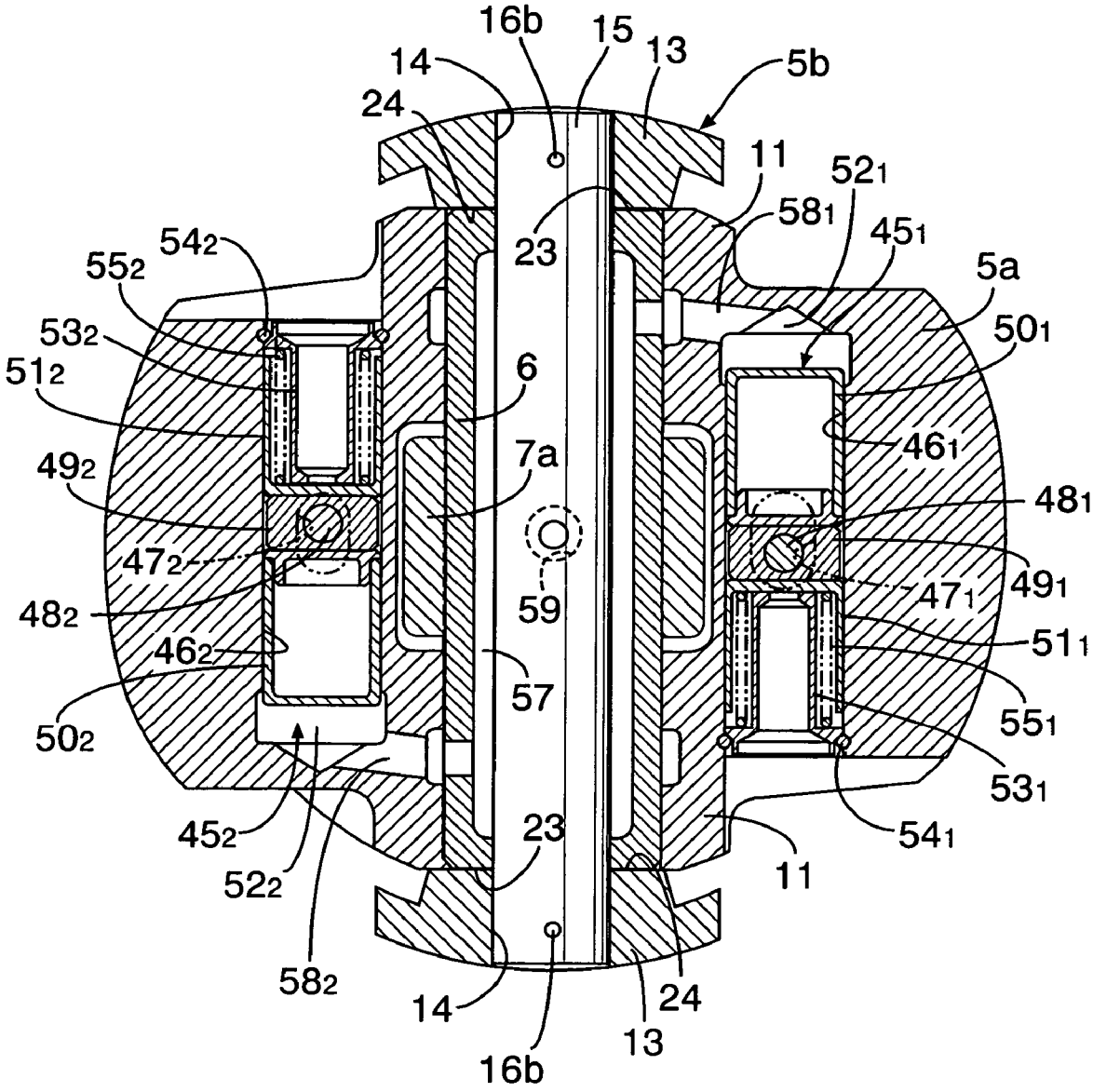
FIG. 11 is a sectional view taken on line 11-11 in FIG. 10.
Figure 12:
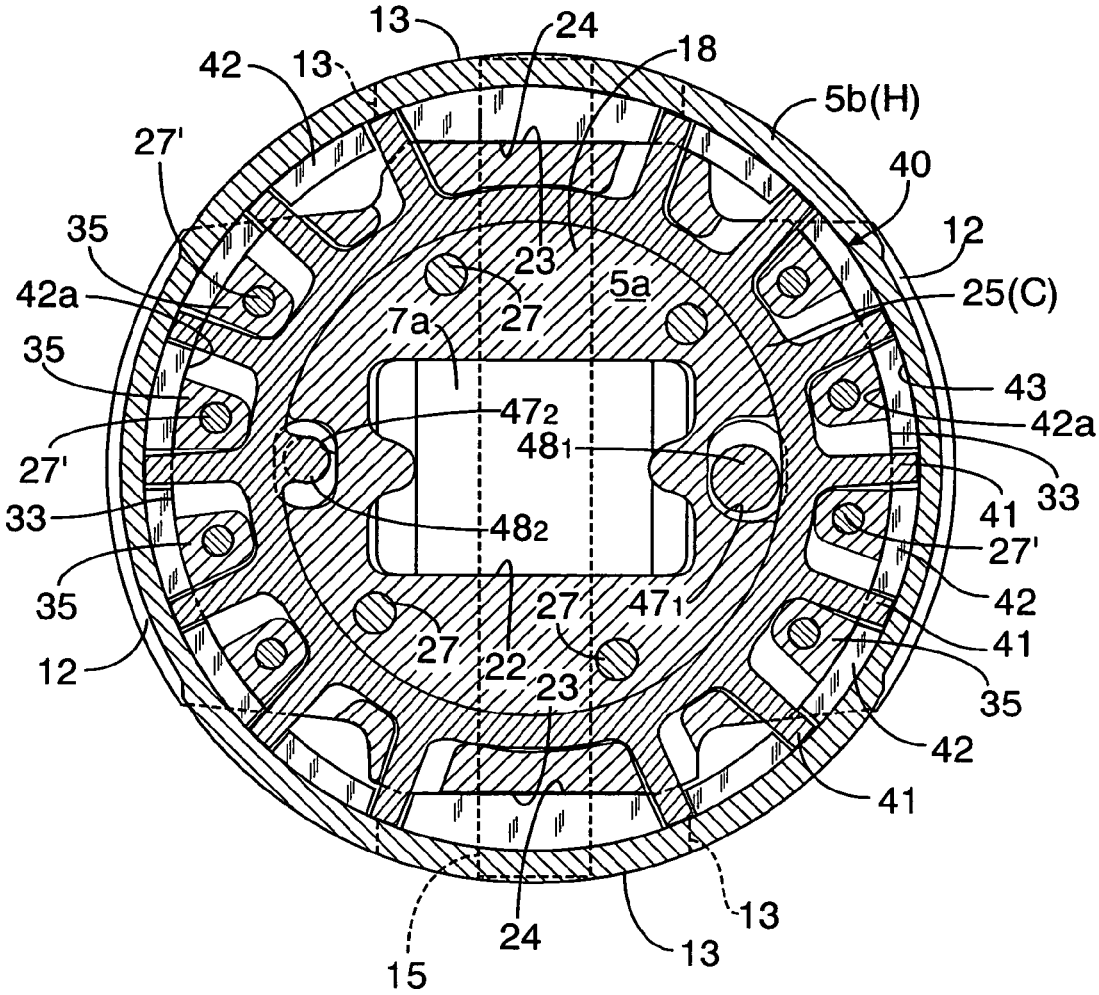
FIG. 12 is a sectional view taken on line 12-12 in FIG. 10.
Figure 13:
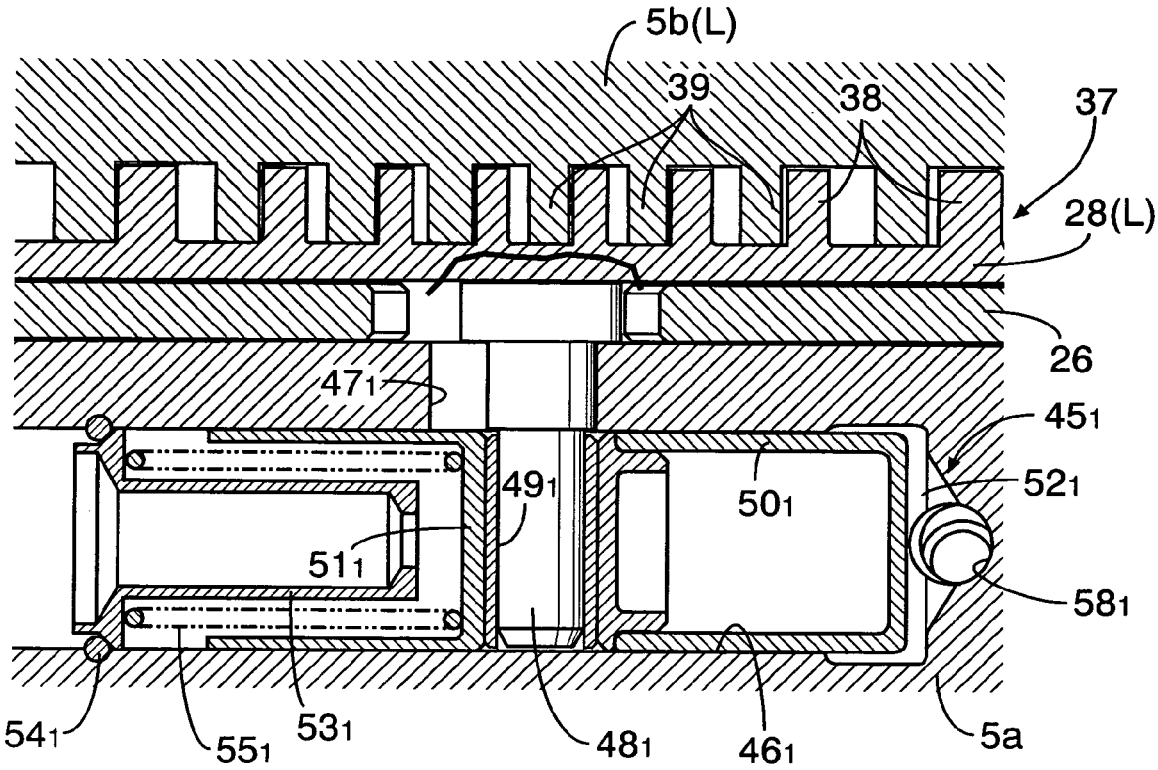
FIG. 13 is a sectional view (low compression ratio state) taken on line 13-13 in FIG. 5.

As shown in FIGS. 2 and 10, in order to reinforce the hold on the lock plate 25 by the first holding plate 26, a plurality of bosses 35, which are disposed in a plurality of groove portions of the male spline 41 to support an undersurface of an outer peripheral portion of the first holding plate 26, are integrally formed on the piston inner part 5*a*. The outer peripheral portion of the first holding plate 26 is fixed to the bosses 35 with a plurality of screws 27'. The bosses 35 are naturally formed so as not to interfere with rotation of the male spline 41 to the lock release position C and the lock position D.

The piston inner part 5*a* is provided with first and second actuators $\mathbf{45}_1$ and $\mathbf{45}_2$ which drive the lift member 28 and the lock plate 25, respectively. They will be described below with reference to FIGS. 5, 6, 13 and 14.

First, the first actuator $\mathbf{45}_1$ will be described. The piston inner part 5*a* is provided with a bottomed cylinder hole $\mathbf{46}_1$ which is provided on one side of the piston pin 6 so as to extend parallel with the piston pin 6, and a long hole $\mathbf{47}_1$ which penetrates through an upper wall of an intermediate portion of the cylinder hole $\mathbf{46}_1$ and the first holding plate 26. A pressure receiving pin $\mathbf{48}_1$ is projectingly provided on the undersurface of the lift member 28 so as to face the cylinder hole $\mathbf{46}_1$ through the long hole $\mathbf{47}_1$.

A disk-shaped slider $\mathbf{49}_1$ which is loosely fitted in the cylinder hole $\mathbf{46}_1$ to be idly movable in a radius direction in the cylinder hole $\mathbf{46}_1$ is mounted to the pressure receiving pin $\mathbf{48}_1$ to be capable of relatively oscillating. In the cylinder hole $\mathbf{46}_1$, an operation plunger $\mathbf{50}_1$ and a bottomed cylindrical return plunger $\mathbf{51}_1$ are slidably fitted with the slider $\mathbf{49}_1$ disposed therebetween. Accordingly, the slider $\mathbf{49}_1$ is interposed between the pressure receiving pin $\mathbf{48}_1$, and the operation plunger $\mathbf{50}_1$ and the return plunger $\mathbf{51}_1$. Circular-arc movement of the pressure receiving pin $\mathbf{48}_1$ around the rotational center of the lift member 28 is allowed by the slider $\mathbf{49}_1$ moving inside the cylinder hole $\mathbf{46}_1$ while sliding between the operation plunger $\mathbf{50}_1$ and the return plunger $\mathbf{51}_1$. In addition, the contact of the respective parts from the pressure receiving pin $\mathbf{48}_1$ to the operation plunger $\mathbf{50}_1$ and the return plunger $\mathbf{51}_1$ is always in contact in a plane, thereby securing abrasion resistance of the contact parts.

A hydraulic chamber $\mathbf{52}_1$ to which an inner end of the operation plunger $\mathbf{50}_1$ is opposed is defined in the cylinder hole $\mathbf{46}_1$. When hydraulic pressure is supplied to the hydraulic chamber $\mathbf{52}_1$, the operation plunger $\mathbf{50}_1$ receives the hydraulic pressure and rotates the lift member 28 to the lift position B via the slider $\mathbf{49}_1$ and the pressure receiving pin $\mathbf{48}_1$, and the long hole $\mathbf{47}_1$ has a size which does not interfere with the movement of the pressure receiving pin $\mathbf{48}_1$ at this time.

A cylindrical spring holding cylinder $\mathbf{53}_1$ is locked at an end portion at an open side of the cylinder hole $\mathbf{46}_1$ via a retaining ring $\mathbf{54}_1$. A return spring $\mathbf{55}_1$ urging the return plunger $\mathbf{51}_1$ toward the pressure receiving pin $\mathbf{48}_1$ is provided under compression between the spring holding cylinder $\mathbf{53}_1$ and the return plunger $\mathbf{51}_1$.

Figure 14:
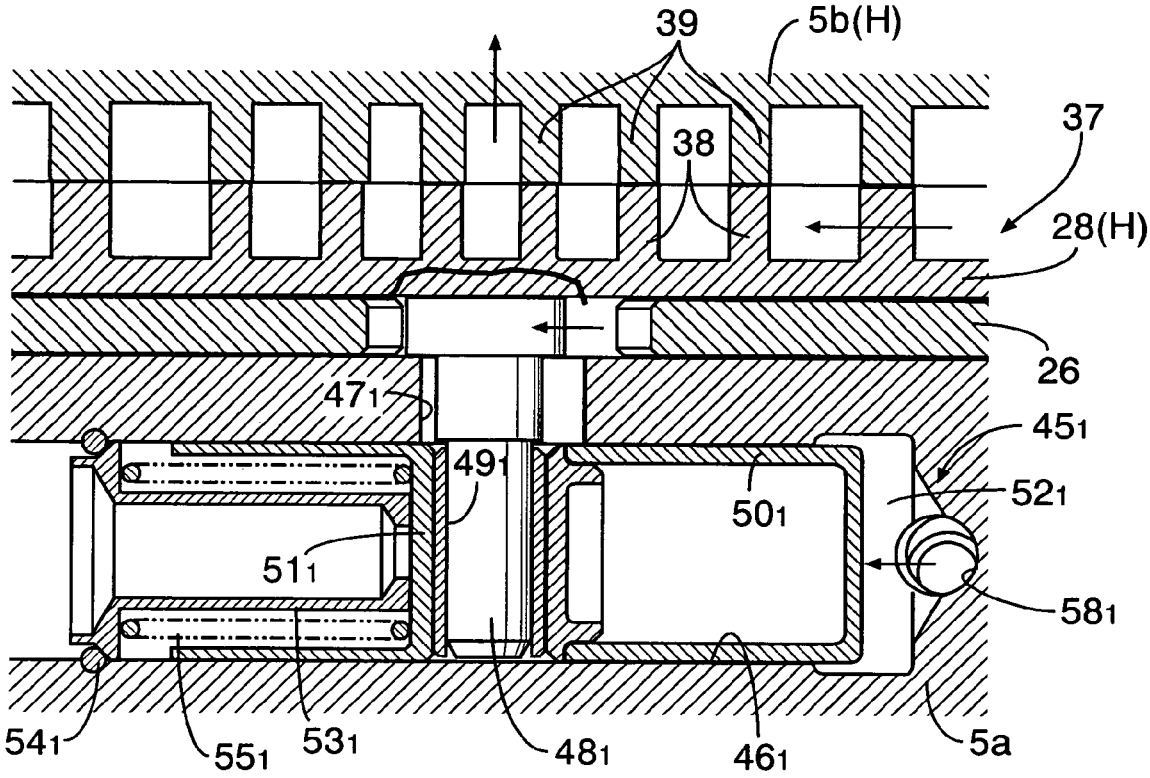
FIG. 14 is a view corresponding to FIG. 13, showing the high compression ratio state.

Thus, the lift release position A of the lift member 28 is defined by the pressure receiving pin $\mathbf{48}_1$ abutting on the inner end wall on the operation plunger $\mathbf{50}_1$ side, of the long hole $\mathbf{47}_1$ (see FIG. 13), and the lift position B of the lift member 28 is defined by the pressure receiving pin $48_1$ abutting on the spring holding cylinder $53_1$ via the slider $49_1$ and the return plunger $51_1$ (see FIG. 14).

The second actuator $45_2$ is disposed to be axisymmetric or point-symmetric with the first actuator $45_1$ with the piston pin 6 disposed therebetween, and a pressure receiving pin $48_2$ is projectingly provided on the undersurface of the lock plate 25. Since the other components are the same as those of the first actuator $45_1$, components corresponding to those of the first actuator $45_1$ in the drawing are denoted by the corresponding reference numerals with only the subscripts changed to "$_2$", and the detailed description thereof will be omitted.

Thus, the lock release position C of the lock plate 25 is defined by the pressure receiving pin $48_2$ abutting on the inner end wall on the operation plunger $50_2$ side, of the long hole $47_2$. The lock position D of the lock plate 25 is defined by the pressure receiving pin $48_2$ abutting on the spring holding cylinder $53_2$ via the slider $49_2$ and the return plunger $51_2$.

If the operational strokes of the pressure receiving pins $48_1$ and $48_2$ are defined by the inner end walls of the long holes $47_1$ and $47_2$, the operational strokes of the pressure receiving pins $48_1$ and $48_2$ can be defined with a high accuracy. If the operational strokes of the pressure receiving pin $48_1$ and $48_2$ are defined by causing the operational plungers $50_1$ and $50_2$ and the return plunger $51_1$ and $51_2$ to abut on the inner end walls of the cylinder holes $46_1$ and $46_2$, loads can be removed from the pressure receiving pins $48_1$ and $48_2$ at the operational limits of the pressure receiving pins $48_1$ and $48_2$.

Thus, the first and the second actuators $45_1$ and $45_2$ are constructed to be of substantially the same structures, and are disposed to sandwich the axial line of the piston inner part 5*a* below the lift member 28 and the lock plate 25 which are superposed from above and from below on the first holding plate 26. The components of the first and the second actuators $45_1$ and $45_2$, which correspond to each other, are given compatibility. Therefore, commonality of the components of the first and the second actuators $45_1$ and $45_2$ is achieved, thereby remarkably reducing the cost.

Figure 6:
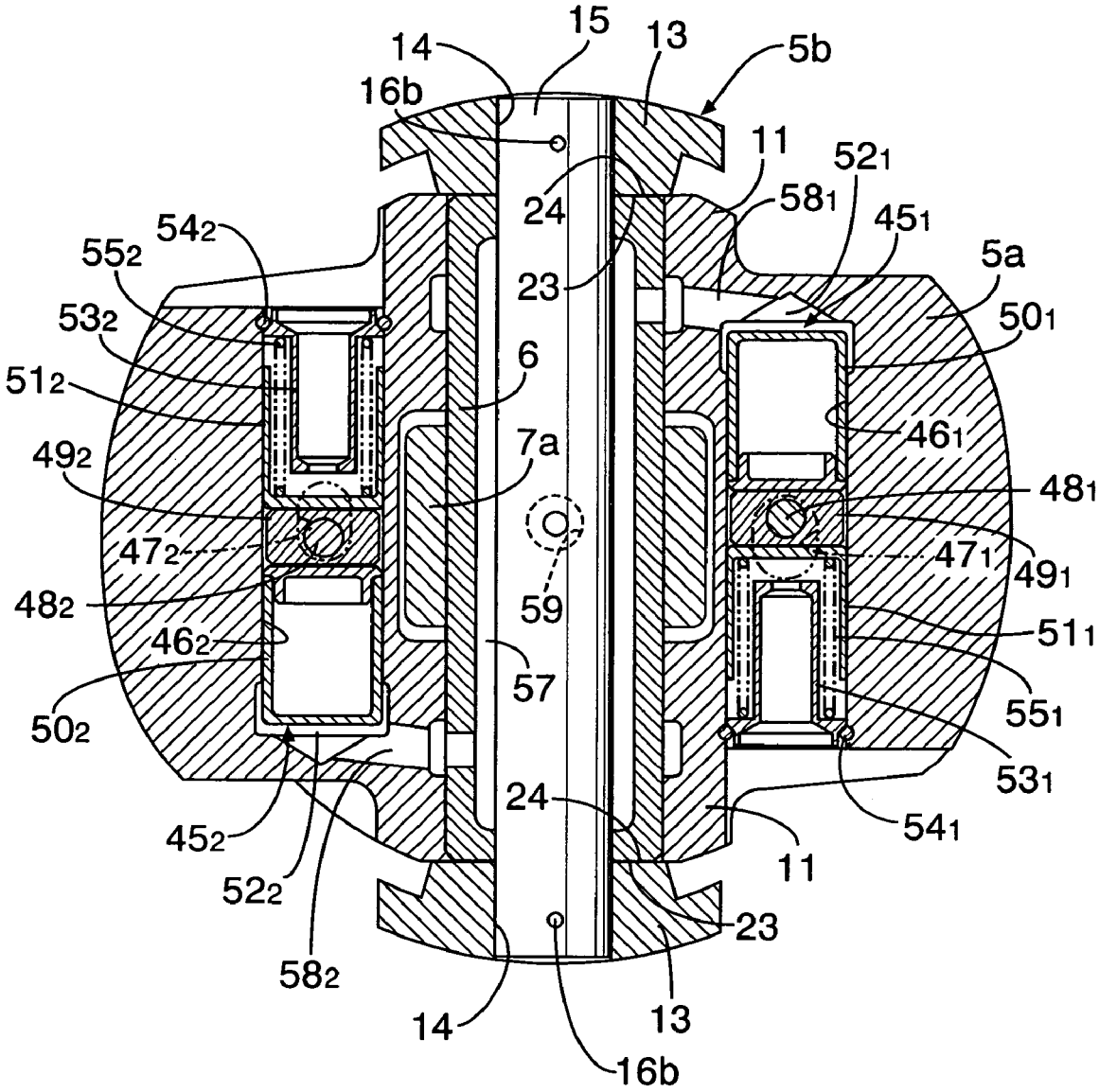
FIG. 6 is a sectional view taken on line 6-6 in FIG. 5.

As shown in FIG. 1 and FIG. 6, a cylindrical oil chamber 57 is defined between the piston pin 6 and the extension shaft 15 fitted into the hollow part of the piston pin 6. First and second distribution oil passages $58_1$ and $58_2$, which connect the oil chamber 57 to the hydraulic chambers $52_1$ and $52_2$ of the first and the second actuators $45_1$ and $45_2$, are provided in and across the piston pin 6 and the piston inner part 5*a*. The oil chamber 57 is connected to an oil passage 59 which is provided in and across the piston pin 6, the connecting rod 7 and the crankshaft 9. The oil passage 59 is switchably connected to an oil pump 61 serving as a hydraulic pressure source and an oil reservoir 62 through an electromagnetic type main switching valve 60. The oil reservoir 62 is an oil pan mounted to a bottom portion of the crankcase 3. Therefore a lubricating oil of the engine E is used as the operating oil of the first and the second actuators $45_1$ and $45_2$.

In FIG. 4, the extension shaft 15 has a hollow part 15*b* whose open surfaces at opposite ends are closed with end plates 15*a*. The hollow part 15*b* communicates with the cylindrical oil chamber 57 in the piston pin 6 through a through-hole 16*a* at a central portion of the extension shaft 15. The hollow part 15*b* also communicates with the long holes 14 of the ear parts 13 via jet holes 16*b* at opposite end portions of the extension shaft 15. In this case, the jet hole 16*b* at each of the end portions of the extension shaft 15 is preferably disposed to open toward the lower end surface of the corresponding long hole 14. In the example shown in the drawing, a plurality of jet holes 16*b* are arranged in the circumferential direction at the end portion of the extension shaft 15, so that even when the piston pin 6 rotates, at least one jet hole 16*b* is oriented to the lower end surface of the long hole 14.

Figure 15:
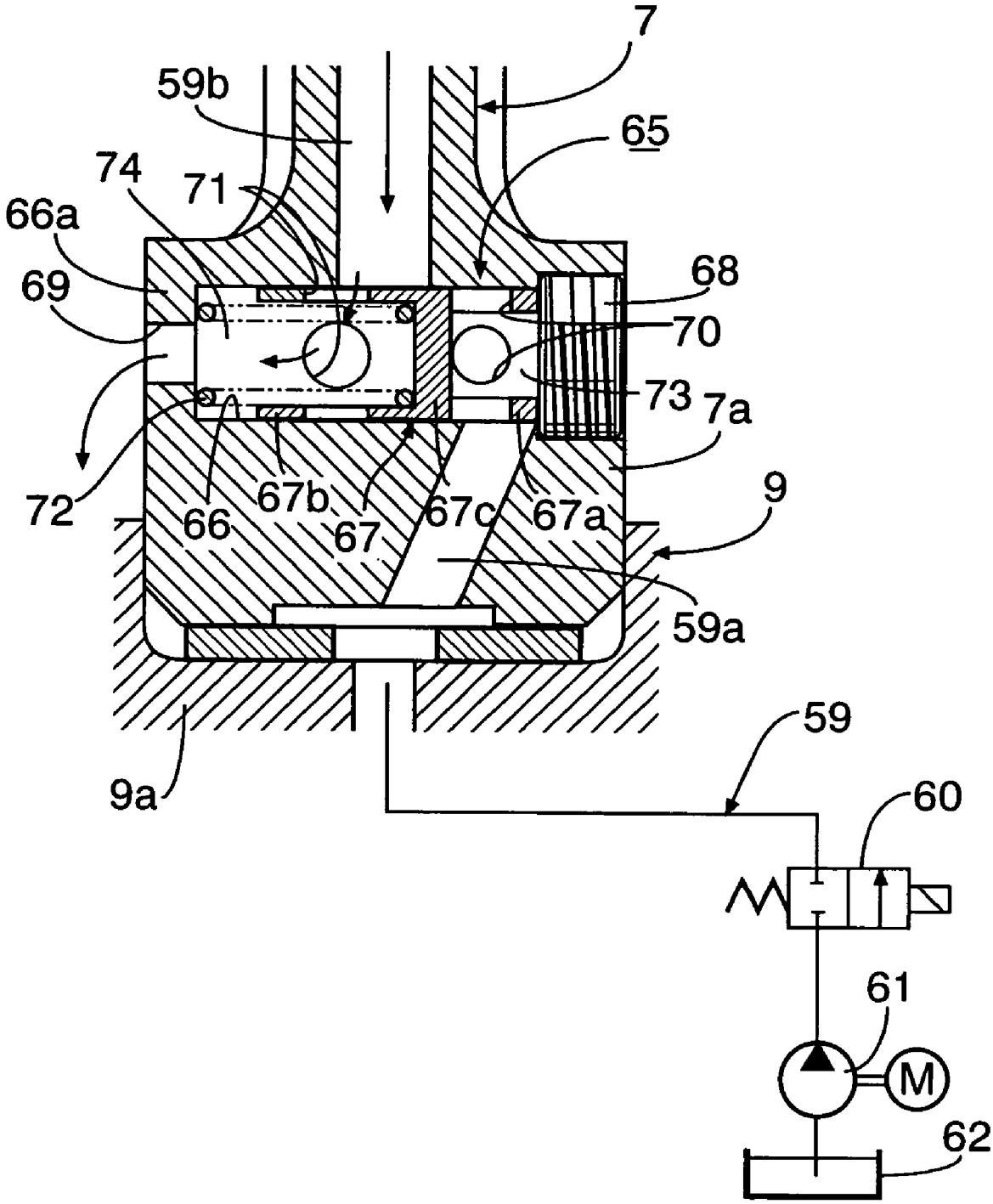
FIG. 15 is an enlarged view (low compression ratio state) of an auxiliary switching valve part in FIG. 1.
Figure 16:
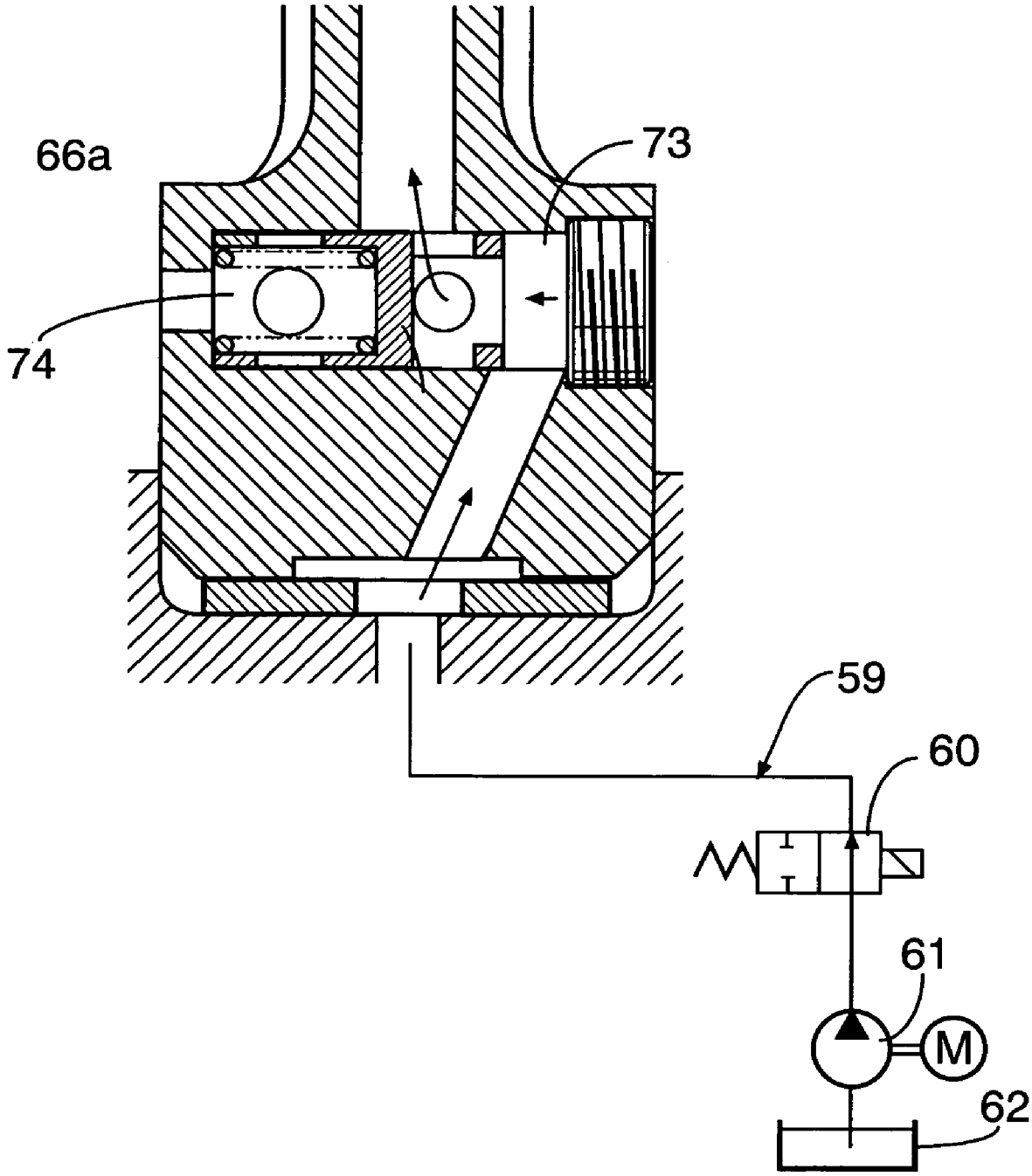
FIG. 16 is a view corresponding to FIG. 15, showing the high compression ratio state.

As shown in FIGS. 15 and 16, a hydraulic auxiliary switching valve 65, which moves the oil passage 59 in response to the discharge pressure of the oil pump 61, is provided in the large end portion 7*b* of the connecting rod 7. The auxiliary switching value 65 includes a valve chamber 66 which is formed in the large end portion 7*b* so as to divide the oil passage 59 into an upstream side oil passage 59*a* on the crank pin 9*a* side and a downstream side oil passage 59*b* on the piston pin 6 side and a piston-shaped valve body 67 slidably housed in the valve chamber 66. The valve chamber 66 and the valve body 67 are disposed so that the operating direction of the valve body 67 is parallel with the crank pin 9*a*. One end portion of the valve chamber 66 is closed with a thread plug 68. A relief hole 69 is provided which allows the valve chamber 66 to directly open into the crankcase 3 in an end wall 66*a* on the side opposite from this one end portion. The valve body 67 is constructed by integrally connecting hollow cylindrical first and second valve parts 67*a* and 67*b* via a partition wall 67*c*. A plurality of inlet holes 70 are arranged in a peripheral wall of the first valve part 67*a* on the thread plug 68 side in the circumferential direction. A plurality of outlet holes 71 are arranged in a peripheral wall of the second valve part 67*b* in the circumferential direction. A valve spring 72, that urges the valve body 67 toward the thread plug 68 with a predetermined set load, is housed in the valve chamber 66. At this time, the valve spring 72 is disposed so that most of its parts are housed in the hollow portion of the second valve part 67*b*, and its movable end portion is in contact under pressure with the partition wall 67*c*.

The valve body 67 moves between a retreat position where it abuts on the thread plug 68 and an advance position where it abuts on the end wall 66*a*. The valve chamber 66 is partitioned into a switching operation chamber 73 on the thread plug 68 side and a relief chamber 74 on the end wall 66*a* side by the partition wall 67*c* of the valve body 67. The upstream side oil passage 59*a* is connected to the switching operation chamber 73. The downstream side oil passage 59*b* is switched to communicate with the release chamber 74 via the outlet hole 71 in the retreat position of the valve body 67, and communicate with the switching operation chamber 73 via the inlet hole 70 in the advance position of the valve body 67.

In order to avoid interference of the lift member 28, the first holding plate 26 and the lock plate 25 with the outer slide flat surfaces 24 of the inner periphery of the piston outer part 5*b* at the time of insertion of the lift member 28, the first holding plate 26 and the lock plate 25 into the piston outer part 5*b*, flat chamfer is provided to the outer peripheral surfaces of the lift member 28 and the first holding plate 26, and a part of the male spline 41 is cut out.

Next, an operation of the first embodiment will be described.

In FIGS. 3 to 8 and FIG. 13, the lift member 28 of the cam mechanism 37 is in the lift release position A and the lock plate 25 is engaged with the lock groove 43, so that the piston outer part 5*b* is held in the low compression ratio position L near the piston inner part 5*a*. Therefore, the compression ratio of the internal combustion engine E operated in this state is controlled to be relatively low.

In order to shift from the above state to the high compression ratio state to increase output power, for example, at the time of high-speed operation of the internal combustion engine E, the main switching valve 60 is brought into an energizing state, that is, ON state to connect the oil passage 59 to the oil pump 61. With this arrangement, the operating oil discharged by the oil pump 61 first flows into the switching operation chamber 73 of the auxiliary switching valve 65 through the upstream side oil passage 59*a*, pushes and moves the valve body 67 by its hydraulic pressure to the advance position against the set load of the valve spring 72 as shown in FIG. 15 and allows the inlet hole 70 of the valve body 67 to communicate with the downstream side oil passage 59*b*. As a result, the operating oil moves to the downstream side oil passage 59*b* through the inlet hole 70, and passes through the first and the second distribution oil passages $\mathbf{58}_1$ and $\mathbf{58}_2$ to be supplied to the hydraulic chambers $\mathbf{52}_1$ and $\mathbf{52}_2$ of the first and the second actuators $\mathbf{45}_1$ and $\mathbf{45}_2$.

Figure 9:
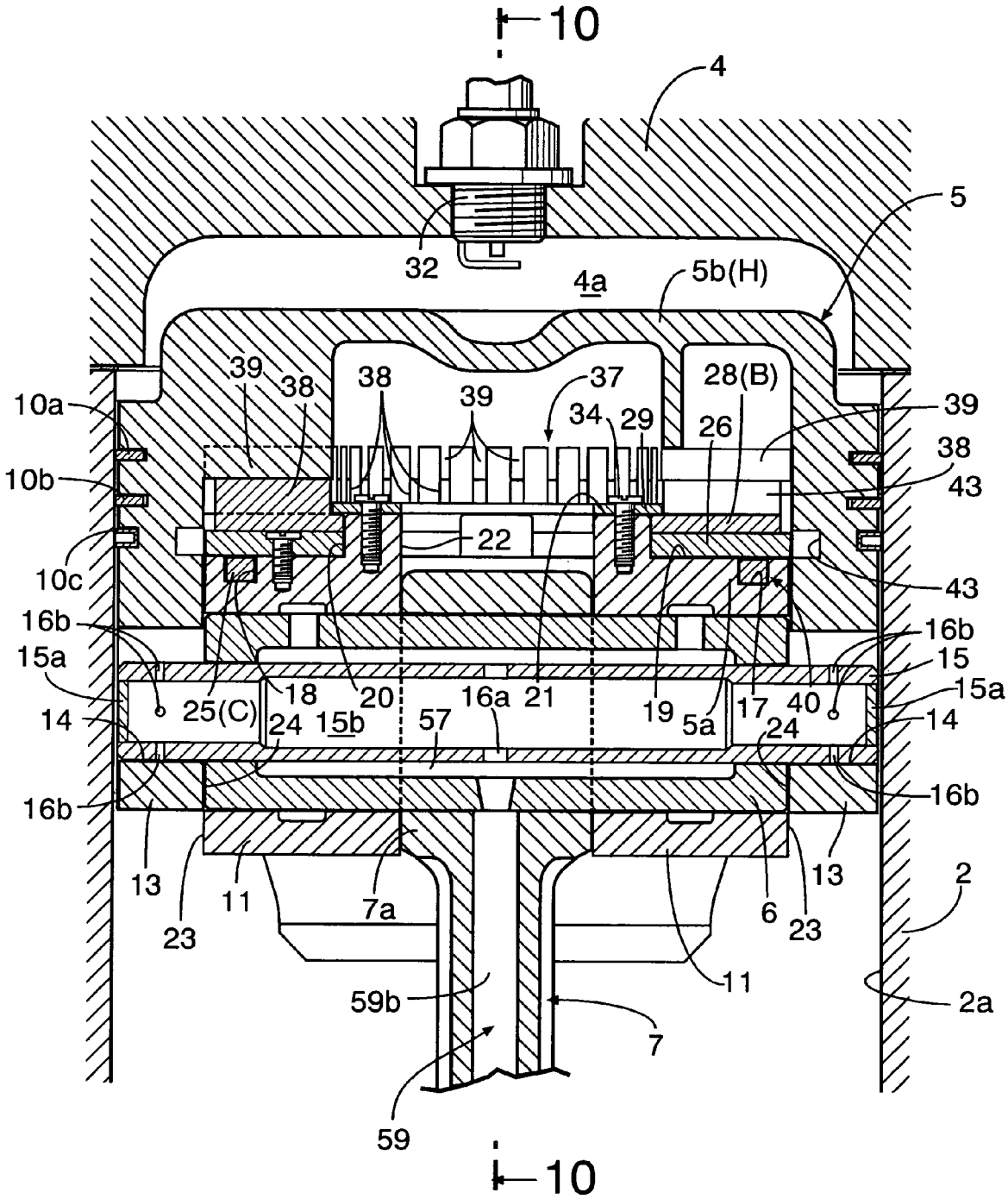
FIG. 9 is a view corresponding to FIG. 4, showing a high compression ratio state.

Then, as shown in FIG. 9, the operation plunger $\mathbf{50}_2$ of the second actuator $\mathbf{45}_2$ first receives the hydraulic pressure of the hydraulic chamber $\mathbf{52}_2$ and presses the pressure receiving pin $\mathbf{48}_2$ together with the slider $\mathbf{49}_2$ against the urging force of the return spring $\mathbf{55}_2$. Therefore, the pressure receiving pin $\mathbf{48}_2$ rotates the lock plate 25 from the lock position D to the lock release position C, thereby establishing a state of slidable fitting between the male spline 41 of the lock plate 25 and the female spline 42 of the piston outer part 5*b*.

Thus, a separating force is generated between the piston inner part 5*a* and the piston outer part 5*b* due to a phenomenon described below. When the piston outer part 5*b* is drawn toward the combustion chamber 4*a* by intake negative pressure in the intake stroke of the engine, when the piston outer part 5*b* is left behind by the piston inner part 5*a* due to frictional resistance generated between the piston rings 10*a* to 10*c* and the inner surface of the cylinder bore 2*a* in the down-stroke of the piston 5, and when the piston outer part 5*b* is lifted from the piston inner part 5*a* due to its inertia force with the speed reduction of the piston inner part 5*a* at the second half of the up-stroke of the piston 5, the piston outer part 5*b* is displaced in the direction to be away from the piston inner part 5*a* toward the combustion chamber 4*a*. With this displacement, the extension shaft 15 supported by the piston inner part 5*a* relatively descends along the long holes 14 of the ear parts 13 of the piston outer part 5*b* to abut on the lower end walls of the long holes 14, thereby preventing the piston outer part 5*b* from being further displaced at the predetermined high compression ratio position H.

Therefore, the moving limit of the piston outer part 5*b* to the high compression ratio position side can be defined without using a special stopper member, thus contributing to simplification of the structure of the device. In addition, the impact upon stoppage of moving of the piston outer part 5*b* toward the high compression ratio position is directly transmitted from the piston outer part 5*b* to the piston pin 6 through the lower end walls of the long holes 14 and the extension shaft 15 which abut on each other, and is not transmitted to the piston inner part 5*a*. Thus, it is possible to prevent the impact from affecting the cam mechanism 37, the lock mechanism 40, the first and the second actuators $\mathbf{45}_1$ and $\mathbf{45}_2$, and the like which are provided at the piston inner part 5*a*, thereby securing their durability and operational stability.

When the piston outer part 5*b* comes to the high compression ratio position H, the first cam top portions 38 of the lift member 28 separate from the bottom portions between the second cam top portions 39 of the piston outer part 5*b*. Therefore, in the first actuator $\mathbf{45}_1$, the operation plunger $\mathbf{50}_1$ under the hydraulic pressure of the hydraulic chamber $\mathbf{52}_1$ presses and moves the pressure receiving pin $\mathbf{48}_1$ together with the slider $\mathbf{49}_1$ against the urging force of the return spring $\mathbf{55}_1$ to rotate the lift member 28 from the lift release position A to the lift position B. Accordingly, as shown in FIG. 14, the flat top surfaces of the first cam top portions 38 and the second cam top portions 39 abut on one another. Namely, the cam mechanism 37 is in the axially extended state.

Thus, the piston outer part 5*b* is held in the high compression ratio position H by the axially expanded state of the cam mechanism 37 and abutment between the extension shaft 15 and the lower end walls of the long holes 14. Accordingly, the piston inner part 5*a* and the piston outer part 5*b* integrally ascend and descend in the cylinder bore 2*a* while increasing the compression ratio, thereby contributing to enhancement in output performance of the engine. Further, in the cam mechanism 37, the abutment surfaces of the top surfaces of the first and the second cam top portions 38 and 39 in annular arrangement which are caused to abut on each other are distributed uniformly on the entire periphery of the piston 5, and the total area is large. Therefore, the cam mechanism 37 can sufficiently endure a high cylinder pressure in the expansion stroke and the compression stroke of the engine E.

When the main switching valve 60 is in ON state where the oil passage 59 is connected to the oil pump 61, the operating oil which has ascended in the oil passage 59 is not only supplied to the first and the second actuators $\mathbf{45}_1$ and $\mathbf{45}_2$, but also supplied into the long holes 14 of the ear parts 13 of the piston inner part 5*a* from the jet holes 16*b* and 16*b* sequentially through the oil chamber 57 in the piston pin 6, the through-hole 16*a* and the hollow part 15*b* of the extension shaft 15, so that the long holes 14 are filled with the operating oil. Therefore, the extension shaft 15 descends in the long holes 14 of the ear parts 13 with the movement of the piston outer part 5*b* from the low compression ratio position L to the high compression ratio position H, the lower half peripheral surface of the extension shaft 15 presses the operating oil in the long holes 14, the operating oil is pushed outside the long holes 14 though the gap around the ear parts 13 and the attenuating force generated at this time alleviates the abutting impact of the extension shaft 15 onto the lower end walls of the long holes 14. Thus, the piston outer part 5*b* can be reliably held at the high compression ratio position H, thereby improving durability of the ear parts 13 and the extension shaft 15.

It is preferable that the jet hole 16*b* provided in the extension shaft 15 is a single member oriented to the lower end wall of the corresponding long hole 14. With this arrangement, when the piston outer part 5*b* comes to the high compression ratio position H, the single jet hole 16*b* is closed by the lower end wall of the corresponding long hole 14 to suppress useless flowout of the operating oil from the jet hole 16*b*, thereby reducing capacity of the oil pump 61.

The loads in the separating directions acting on the piston outer part 5*b* and the piston inner part 5*a* in the intake stroke or the like can be reliably supported by the extension shaft 15 supported by the piston inner part 5*a* and the ear parts 13 of the piston outer part 5*b* having the long holes 14 in which the extension shaft 15 is fitted. The extension shaft 15 and the long holes 14 serves to prevent the relative rotation between the piston inner part 5*a* and the piston outer part 5*b*, thereby contributing to simplification of the structure. In addition, the piston outer part 5*b* has a sufficient strength by only thickening the ear parts 13 forming the long holes 14, thus contributing to reduction in weight of the piston outer part 5*b*, and further in weight of the piston 5.

In order to switch the engine E from the high compression ratio state to the low compression ratio state, the main switching valve 60 is brought into the OFF state, that is, the non-energized state as shown in FIG. 15 to cause the oil passage 59 to open to the oil reservoir 62. Then, first with depressurization of the upstream side oil passage 59*a*, the switching operation chamber 73 of the auxiliary switching valve 65 is also depressurized, and therefore the valve body 67 immediately returns to the retreat position by the urging force of the valve spring 72, thereby allowing the outlet hole 71 to communicate with the downstream side oil passage 59*b*. As a result, the downstream side oil passage 59*b* is directly opened to the crank chamber 3*a* (see FIG. 1) through the outlet hole 71, the release chamber 74 and the release hole 69 of the auxiliary switching valve 65.

Thereafter, before and after the piston 5 passes through the bottom dead center, the operating oil in the downstream side oil passage 59*b* in the connecting rod 7 has a downward inertia force, and therefore it voluntarily escapes quickly from the release hole 69 of the auxiliary switching valve 65 into the crank chamber 3*a*. As a result, the hydraulic chambers $\mathbf{52}_1$ and $\mathbf{52}_2$ of the first and second actuators $\mathbf{45}_1$ and $\mathbf{45}_2$ which connect to the downstream side oil passage 59*b* are immediately depressurized, so that the pressure receiving pins $\mathbf{48}_1$ and $\mathbf{48}_2$ of the first and the second actuators $\mathbf{45}_1$ and $\mathbf{45}_2$ are respectively put under control of the return plungers $\mathbf{51}_1$ and $\mathbf{51}_2$ which receive the urging forces of the return springs $\mathbf{55}_1$ and $\mathbf{55}_2$.

The process after the main switching valve 60 is brought into OFF state until the hydraulic chambers $\mathbf{52}_1$ and $\mathbf{52}_2$ of the first and the second actuators $\mathbf{45}_1$ and $\mathbf{45}_2$ are depressurized, will be described with reference to the diagrams in FIGS. 17 and 18.

Figure 17:
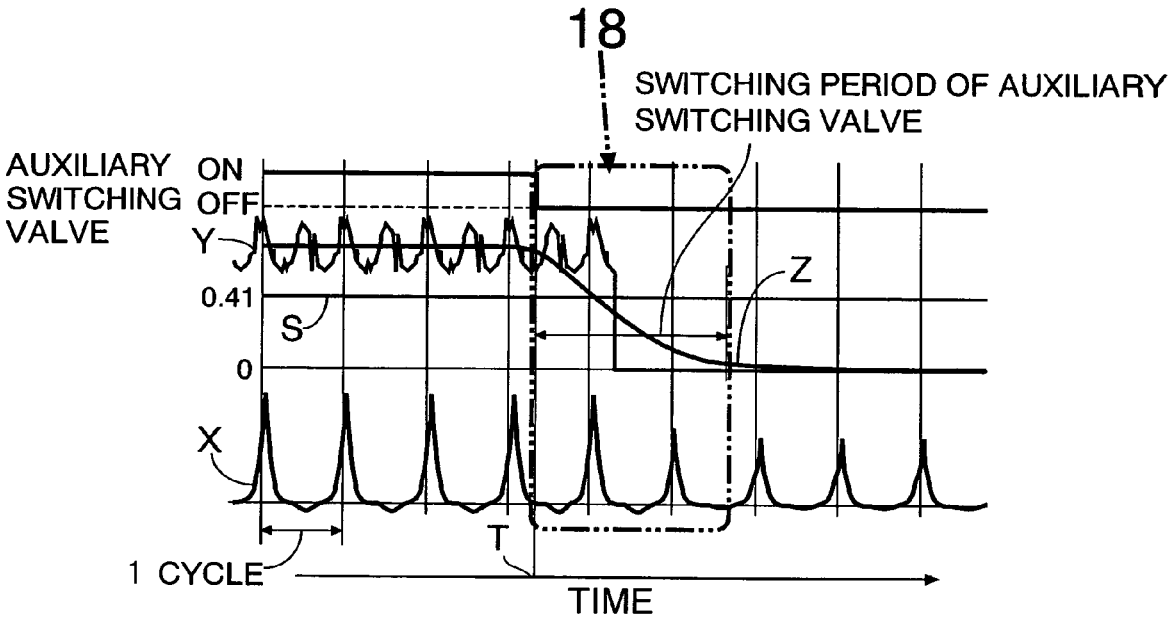
FIG. 17 is a diagram showing a hydraulic pressure change of the hydraulic actuator with the operation of the auxiliary switching valve.
Figure 18:
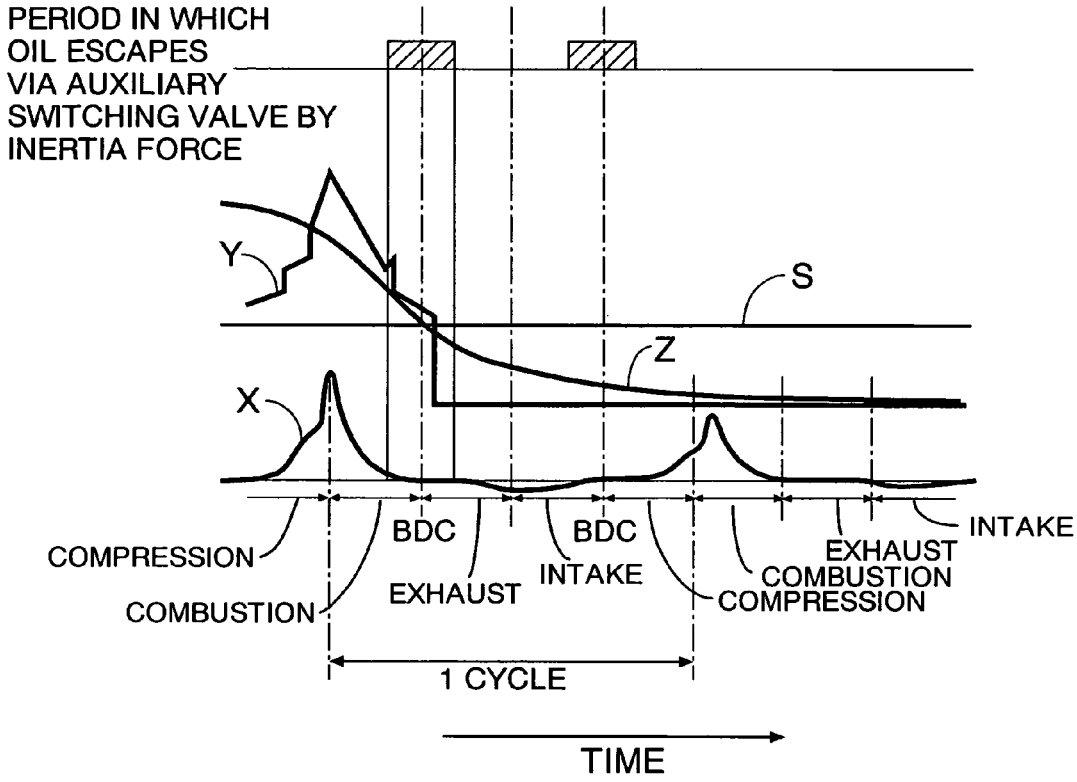
FIG. 18 is an enlarged view of part 18 in FIG. 17.

In FIGS. 17 and 18, a line X represents the pressure in the cylinder of the engine E, a line Y represents the pressure of the hydraulic chambers $\mathbf{52}_1$ and $\mathbf{52}_2$ of the first and the second actuators $\mathbf{45}_1$ and $\mathbf{45}_2$, and a line Z represents the discharge pressure of the oil pump 61 acting on the switching operation chamber 73 of the auxiliary switching valve 65. A line S represents the threshold value of the pressure acting on the hydraulic chambers $\mathbf{52}_1$ and $\mathbf{52}_2$. When the pressure becomes the threshold value S or higher, the first and the second actuators $\mathbf{45}_1$ and $\mathbf{45}_2$ are brought into the operating state. When the pressure becomes lower than the threshold value S, the first and the second actuators $\mathbf{45}_1$ and $\mathbf{45}_2$ are brought into the non-operating state.

The reason why the pressure of the hydraulic chambers $\mathbf{52}_1$ and $\mathbf{52}_2$ pulses in the ON state of the main switching valve 60, is that the direction of the inertia force of the operating oil of the hydraulic chambers $\mathbf{52}_1$ and $\mathbf{52}_2$ and the oil passage 59 changes with the reciprocal movement of the piston 5 and the connecting rod 7.

When the main switching valve 60 is brought into the OFF state at a time T and the auxiliary switching valve 65 is retreated, there are time periods, before and after the bottom dead center between the explosion stroke and the exhaust stroke of the engine E as well as before and after the bottom dead center between the intake stroke and the compression stroke of the engine E, where the operating oil of the downstream side oil passage 59*b* has a downward inertia force. Therefore, in either of these periods, the operating oil in the downstream side oil passage 59*b* is discharged from the release hole 69 of the auxiliary switching valve 65 into the crank chamber 3*a*, thereby quickly reducing the pressure of the hydraulic chambers $\mathbf{52}_1$ and $\mathbf{52}_2$ below the threshold value.

If such an auxiliary switching valve 65 is not available, the set loads of the return springs $\mathbf{55}_1$ and $\mathbf{55}_2$ are inevitably set to be large in the first and the second actuators $\mathbf{45}_1$ and $\mathbf{45}_2$. Therefore, with this setting, the operating oil pressure of the operation plungers $\mathbf{51}_1$ and $\mathbf{51}_2$, that is, the discharge pressure of the oil pump 61 needs to be increased, leading to an increased pressure of the oil pump 61, and also to an increased power consumption for driving the oil pump 61.

When the pressure of the hydraulic chambers $\mathbf{52}_1$ and $\mathbf{52}_2$ reduces below the threshold value in this way, first in the first actuator $\mathbf{45}_1$, the return plunger $\mathbf{51}_1$ presses and moves the pressure receiving pin $\mathbf{48}_1$ together with the slider $\mathbf{49}_1$ toward the hydraulic chamber $\mathbf{52}_1$ to rotate the lift member 28 to the lift release position A, so that the first cam top portions 38 and the second cam top portions 39 enter the position where their top parts are displaced from each other. Therefore, in the discharge stroke, the expansion stroke, the compression stroke and the like of the engine, when the piston outer part 5*b* is pressed against the piston inner part 5*a* by the pressure in the cylinder, when the piston outer part 5*b* is pressed against the piston inner part 5*a* by the frictional resistance generated between the piston rings 10*a* to 10*c* and the inner surface of the cylinder bore 2*a* in the up-stroke of the piston 5, and when the piston outer part 5*b* is pressed against the piston inner part 5*a* by its inertia force with speed reduction of the piston inner part 5*a* at the second half of the down-stroke of the piston 5, the piston outer part 5*b* is displaced to near the piston inner part 5*a* while the first cam top portions 38 and the second cam top portions 39 are meshed with one another, and the low compression ratio position L of the piston outer part 5*b* is determined by the top parts of the cam top portions 39 on one side abutting against the bottoms of the bottom portions between the cam top portions 38 on the other side.

When the piston outer part 5*b* reaches the low compression ratio position L, the male spline 41 of the lock plate 25 becomes capable of entering the lock groove 43 of the piston outer part 5*b*, and therefore the return plunger $\mathbf{51}_2$ of the second actuator $\mathbf{45}_2$ presses and moves the pressure receiving pin $\mathbf{48}_2$ together with the slider $\mathbf{49}_2$ toward the hydraulic chamber $\mathbf{52}_2$ by the urging force of the return spring $\mathbf{55}_2$, and rotates the lock plate 25 to the lock position D to bring the lock mechanism 40 into a lock state. Namely, the male spline 41 of the lock plate 25 is caused to face the upper end surface of the female spline 42 of the piston outer part 5*b*, thereby inhibiting sliding of both the splines 41 and 42 with respect to each other.

The first holding plate 26 which suppresses a rise of the lock plate 25 from the first support surface 17 of the piston inner part 5*a* is supported by the second support surface 19 of the piston inner part 5*a*. Thus, even when a thrust load acts on the first holding plate 26 from the cam mechanism 37 side, the load is received by the second support surface 19 and is inhibited from being transmitted to the lock plate 25. Therefore, the lock plate 25 can always rotate smoothly around the first pivotal shaft 18.

Thus, the piston outer part 5*b* is held in the low compression ratio position L by the axially contracted state of the cam mechanism 37 and the lock state of the lock mechanism 40. Even in this state, in the cam mechanism 37, the top parts of the cam top portions 39 on one of the first and second cam top portions 38 and 39 in the annular arrangement abut against the bottoms of the bottom portions between the cam top portions 38 on the other side, and therefore their abutting surfaces are uniformly distributed in the entire periphery of the piston 5, and the total area is large. Thus, the cam mechanism 37 can sufficiently endure the large pressure in the cylinder in the expansion stroke and the compression stroke of the engine E.

Further, the loads acting on the piston outer part 5*b* and the piston inner part 5*a* in the separating directions in the intake stroke or the like, acts on end surface abutting portions of the male spline 41 of the lock plate 25 and the female spline 42 of the piston outer part 5*b*. The end surface abutting portions are also uniformly distributed on the entire periphery of the piston 5, and the total area is large. Therefore, the lock mechanism 40 can sufficiently endure the loads in the separating directions.

As described above, the cam mechanism 37 is annularly placed between the piston inner part 5*a* and the piston outer part 5*b*, thereby allowing the piston inner part 5*a* and the piston outer part 5*b* to abut on each other in their entire peripheries via the cam mechanism 37. Therefore, heat transmission between the piston inner part 5*a* and the piston outer part 5*b*, especially heat transfer from the piston outer part 5*b* at a high temperature to the piston inner part 5*a* at a low temperature is smooth, thereby securing a favorable cooling performance of the piston 5. At the same time, transmission of a-thrust force between the piston inner part 5*a* and the piston outer part 5*b* is efficient, thus contributing to an enhancement in the durability of the piston 5.

In addition, since the skirt parts 12 whose sliding is guided by the inner peripheral surface of the cylinder bore 2*a* of the engine E are integrally formed with the piston inner part 5*a*, and the peripheral wall of the piston outer part 5*b*, to which the piston rings 10*a* to 10*c* are fitted, is terminated directly above the skirt parts 12, the piston outer part 5*b* does not have the skirt parts. Therefore, even when the piston outer part 5*b* switches the position between the low compression ratio position L and the high compression ratio position H by using its inertia force, the piston outer part 5*b* can smoothly perform switching to the above described positions without interference by the frictional resistance between the skirt parts 12 and the inner peripheral surface of the cylinder bore 2*a*.

Since the skirt parts 12 are formed in the piston inner part 5*a*, the overlapping portions of the piston inner part 5*a* and the piston outer part 5*b* greatly decrease, so that significant weight reduction of the piston is achieved, thus contributing to enhancement in output performance and durability of the engine E.

Further, the relative rotation between the piston inner part 5*a* and the piston outer part 5*b* can be reliably inhibited by the remarkably simple structure in which the extension shaft 15 projecting from opposite ends of the piston pin 6 is slidably fitted in the long holes 14 of the ear parts 13 of the piston outer part 5*b* which is disposed to be opposed to the piston pin 6 without interference by the skirt parts 12 of the piston inner part 5*a*.

The opening 22 which the small end portion 7*a* of the connecting rod 7 faces is provided in the central portion of the second pivotal shaft 20 of the piston inner part 5*a*, and the scattering lubricating oil generated in the crankcase 3, i.e., the crank chamber 3*a*, passes through the opening 22. Therefore, during operation of the engine E, the scattered lubricating oil is supplied to the cam mechanism 37 through the opening 22 to lubricate and cool the mechanism 37, thus contributing to enhancement in reliability of the operation and durability. Further, since the lubricating oil of the engine E is used as the operating oil of the first and the second actuators $\mathbf{45}_1$ and $\mathbf{45}_2$, also the operating oil leaking from the actuators $\mathbf{45}_1$ and $\mathbf{45}_2$ further effectively performs lubrication of the cam mechanism 37.

Since the valve body 67 of the auxiliary switching valve 65 provided at the large end portion 7*b* of the connecting rod 7 performs rotational movement together with the large end portion 7*b*, it receives a simple centrifugal force. Therefore, during reciprocal movement of the piston 5, the valve body 67 receives a small impact, thus easily securing durability. In addition, during rotation of the large end portion 7*b*, the valve body 67 receives the centrifugal force in the direction perpendicular to its operating direction, thereby avoiding a malfunction due to the centrifugal force. This arrangement enables a low set load of the valve spring 72, and is effective in enhancing hydraulic responsiveness of the valve body 67.

Although the set load of the valve spring 72 for urging the valve body 67 in the retreat direction depends on the rise in pressure by the centrifugal force of the residual oil in the switching operation chamber 73, but it goes without saying that the set load needs to be capable of maintaining the valve body 67 in the retreat position.

As described above, the lock plate 25 and the lift member 28 are constructed to be of rotational type members which are rotatably supported by the first and second pivotal shafts 18 and 20 integral with the piston inner part 5*a*. In addition, the first and the second actuators $\mathbf{45}_1$ and $\mathbf{45}_2$ which operate them are disposed with the axial line of the piston inner part 5*a* disposed therebetween, thereby reducing weight and size of the piston 5. Especially by the layout in which the first and the second actuators $\mathbf{45}_1$ and $\mathbf{45}_2$ are disposed below the lift member 28 and the lock plate 25 which are superposed on each other, thereby reasonably arranging the lift member 28 and the lock plate 25, and the first and the second actuators $\mathbf{45}_1$ and $\mathbf{45}_2$ in a concentrated manner, thereby further reducing weight and size of the piston 5.

In addition, both the rotational type lift member 28 and lock plate 25 are given vibrations due to reciprocal movement of the piston and are supplied with lubricating oil, thereby reliably rotationally operating them by the single first and second actuators, respectively.

Figure 19:
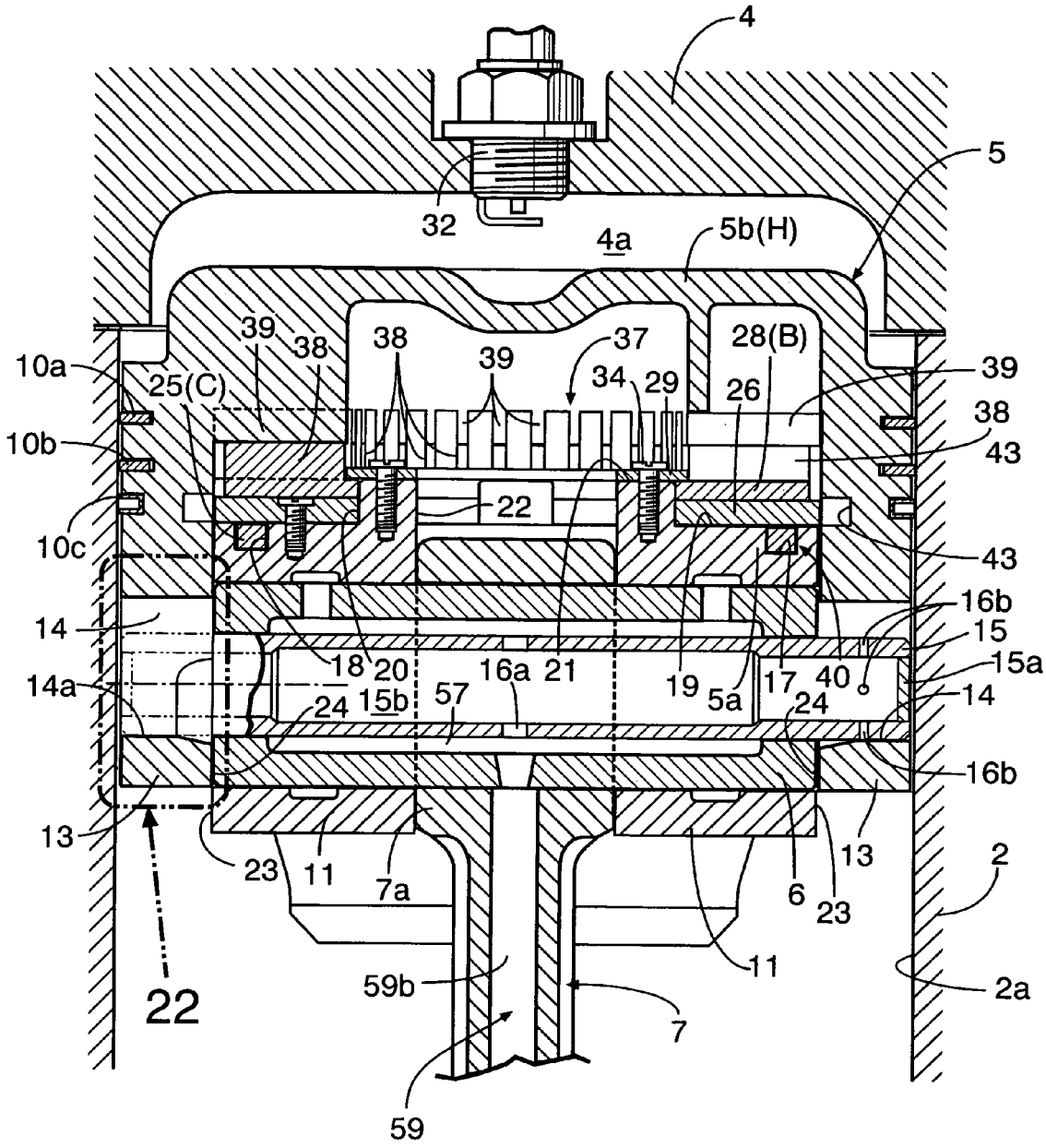
FIG. 19 is a view corresponding to FIG. 9, showing a second embodiment of the present invention.
Figure 20:
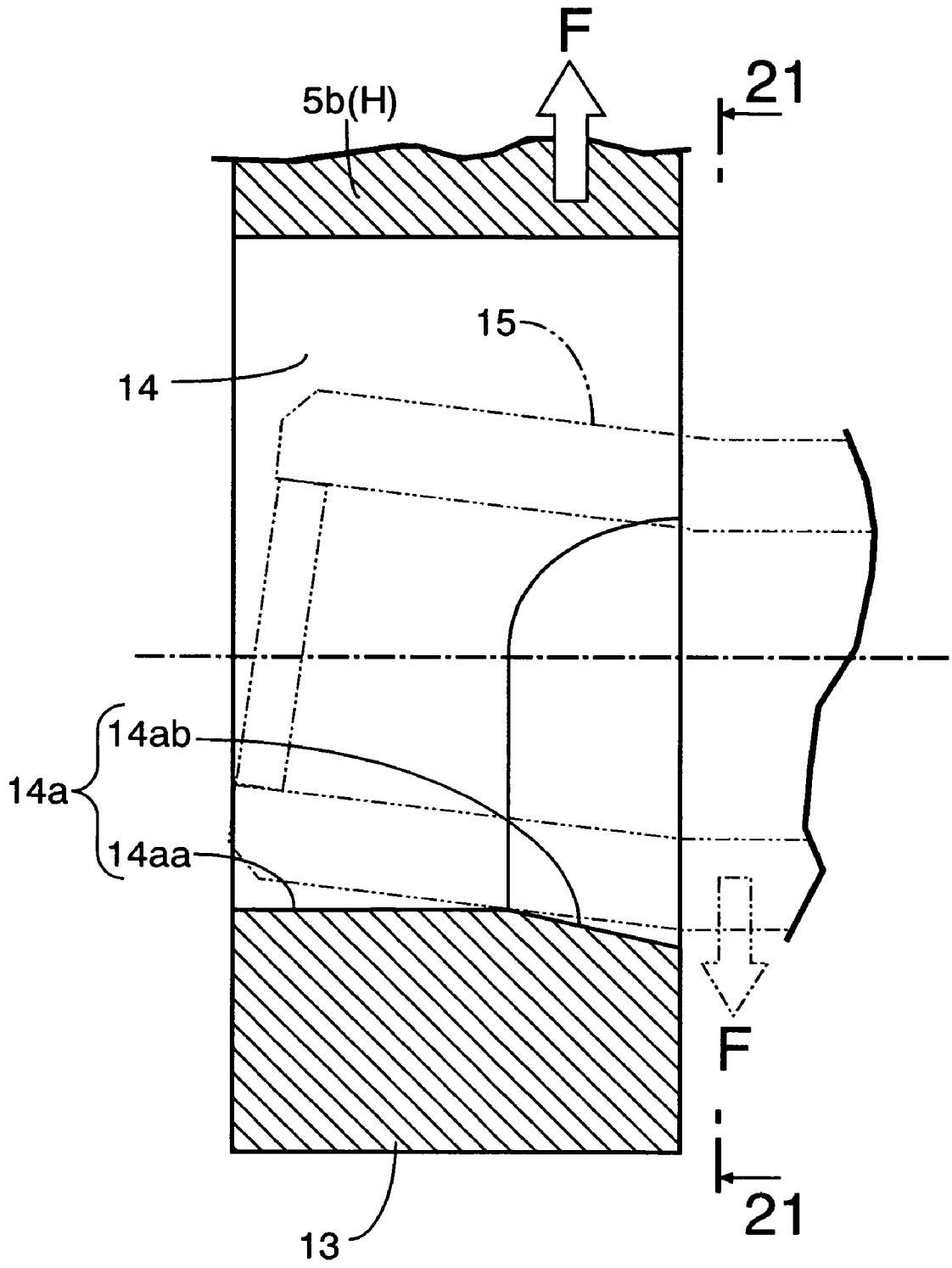
FIG. 20 is an enlarged view of part 22 in FIG. 19.
Figure 21:
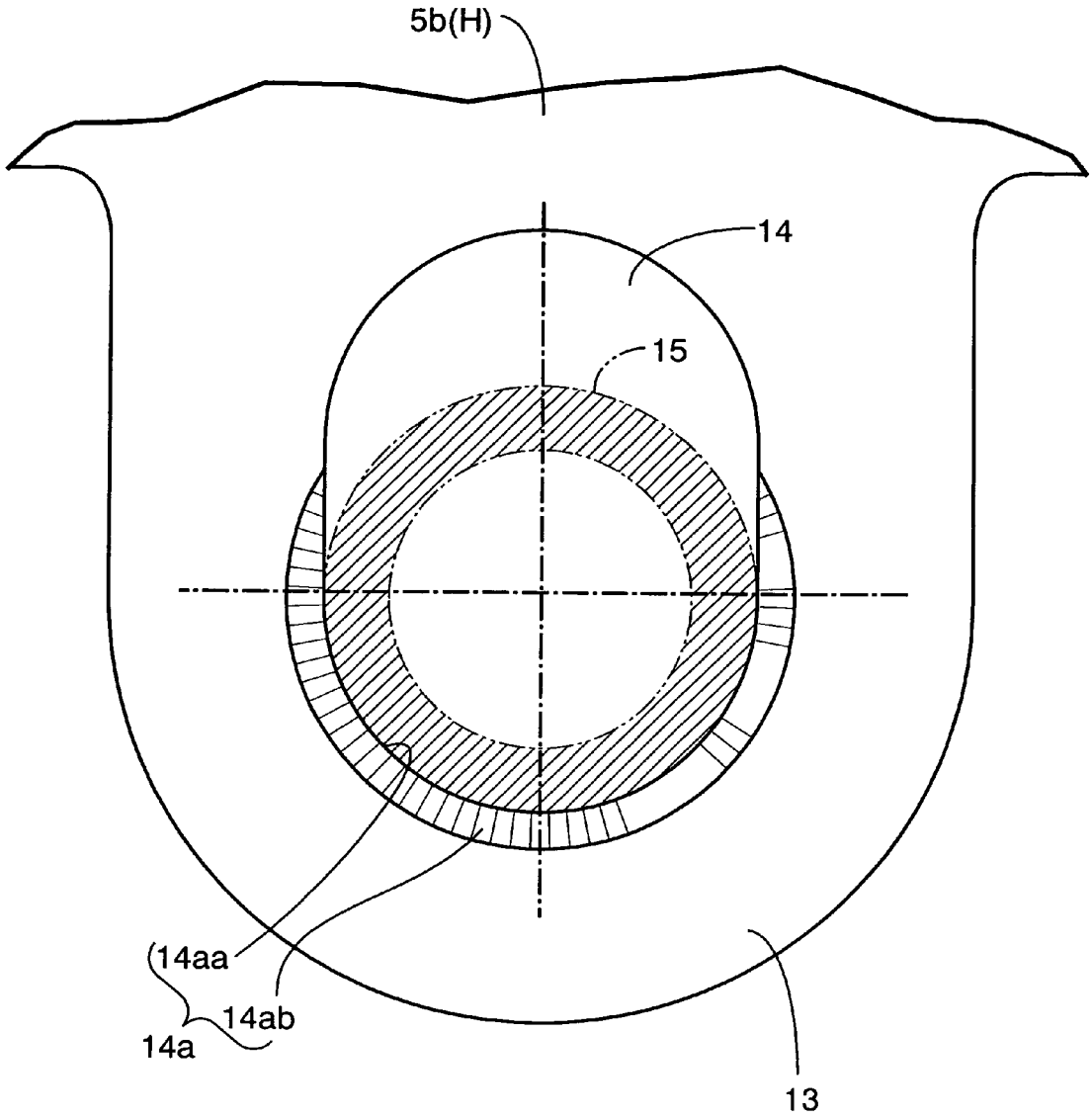
FIG. 21 is a sectional view taken from an arrow of 21-21 line in FIG. 20.

Next, a second embodiment of the present invention will be described with reference to FIGS. 19 to 21.

In the second embodiment, a lower end wall 14*a* of each long hole 14 in a pair of ear parts 13 and 13 of a piston outer part 5*b* comprises: a semicylindrical wall 14*aa* that has one end connected to an outer peripheral surface of the piston outer part 5*b* and corresponds to a half of an outer peripheral surface of an extension shaft 15; and a semi-conical wall 14*ab* extending from the other end of the semicylindrical wall 14*aa* to an inner peripheral surface of the piston outer part 5*b*, and has a larger diameter toward the inner peripheral surface. The semi-conical wall 14*ab* forms an escape for preventing the extension shaft 15 from coming into contact with an inner edge of the lower end wall 14*a* when the extension shaft 15 is bent by an abutment shock against the lower end wall 14*a*. The other components are the same as those of the first embodiment, thus, components in FIGS. 19 to 21 corresponding to those of the first embodiment are denoted by the same reference numerals and symbols, and overlapping descriptions will be omitted.

During an operation of the internal combustion engine E, when a main switching valve 60 is turned ON to switch the piston outer part 5*b* from a low compression ratio position L to a high compression ratio position H, and thus a pressure receiving pin $\mathbf{48}_2$ rotates a lock plate 25 from a locking position D to an unlocking position C to allow a male spline 41 of the lock plate 25 and a female spline 42 of the piston outer part 5*b* to be slidably fitted to each other, an axial separating force F caused by an upward inertial force of the piston outer part 5*b* is applied between the piston outer part 5*b* and the piston inner part 5*a* as described above, so that the piston outer part 5*b* is moved down relative to the piston inner part 5*a*. Therefore, the extension shaft 15 supported by the piston inner part 5*a* is moved down in the long holes 14 and 14 in the ear parts 13 and 13 of the piston outer part 5*b* to abut against the lower end walls 14*a* and 14*a* thereof, thereby controlling the piston outer part 5*b* to a predetermined high compression ratio position H. If such an operation is performed during a high speed operation of the internal combustion engine E, the strong separating force F causes an end of the extension shaft 15 to abut against the lower end wall 14*a* of the long hole 14 with a shock, which may cause the end of the extension shaft 15 to be elastically bent upward as shown in FIG. 20. In this case, if the entire lower end wall 14*a* of each long hole 14 is formed into the semicylindrical shape corresponding to the half of the outer peripheral surface of the extension shaft 15 as in the first embodiment, the bent end of the extension axis 15 strongly abuts against a corner of the semicylindrical lower end wall 14*a* on the side of the center of the piston outer part 5*b* to cause a shock. The repeatedly applied shock may cause damage to the corner, or repeatedly applied outward bending moment to the ear part 13 may cause damage to the ear part 13.

On the other hand, in the second embodiment, the semi-conical wall 14*ab*, that is, the escape is provided in the inner end of the lower end wall 14*a* of the long hole 14 in the ear part 13 on the side of the center of the piston outer part 5*b* to prevent the bent end of the extension shaft 15 from coming into contact with the corner of the lower end wall 14*a* of the long hole 14 on the side of the center of the piston outer part 5*b*, thereby preventing damage to the corner. At this time, the bent end of the extension shaft 15 strongly abuts against a boundary between the semicylindrical wall 14*aa* and the semi-conical wall 14*ab* that constitute the lower end wall 14*a* of the long hole 14, that is, an intermediate portion of the lower end wall 14*a*, but outward bending moment applied to the ear part 13 by a load applied to the intermediate portion of the lower end wall 14*a* is relatively small to prevent damage to the ear part 13, thereby improving durability of the piston outer part 5*b*.

When the piston outer part 5*b* is moved from the low compression ratio position L to the high compression ratio position H by the axial separating force during a low or middle speed operation of the internal combustion engine E, the separating force is relatively small, and thus an abutment shock of the end of the extension shaft 15 against the lower end wall 14*a* of the long hole 14 is relatively small, thereby causing substantially no bending of the end of the extension shaft 15. Thus, in such a state, the end of the extension shaft 15 is supported by a large pressure receiving area of the semicylindrical wall 14*aa* of the lower end wall 14*a* of the long hole 14, thereby securing wear part resistance thereof. Further, the semi-conical wall 14*ab* that forms the escape is placed only in the lower end wall 14*a* of the long hole 14, without reducing strength of a root of the ear part 13.

Figure 22:
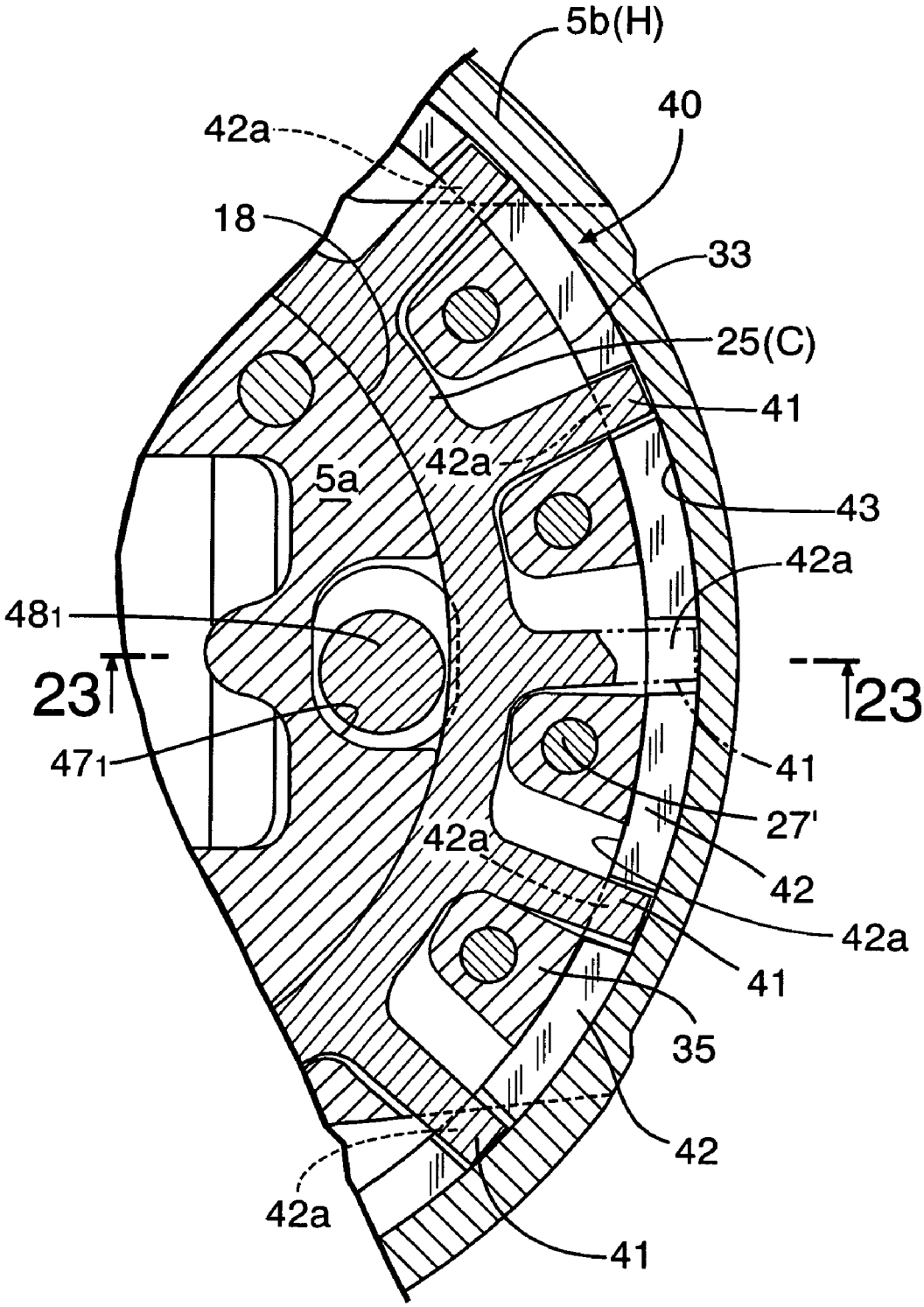
FIG. 22 is a view corresponding to FIG. 12, showing a third embodiment of the present invention.
Figure 23:
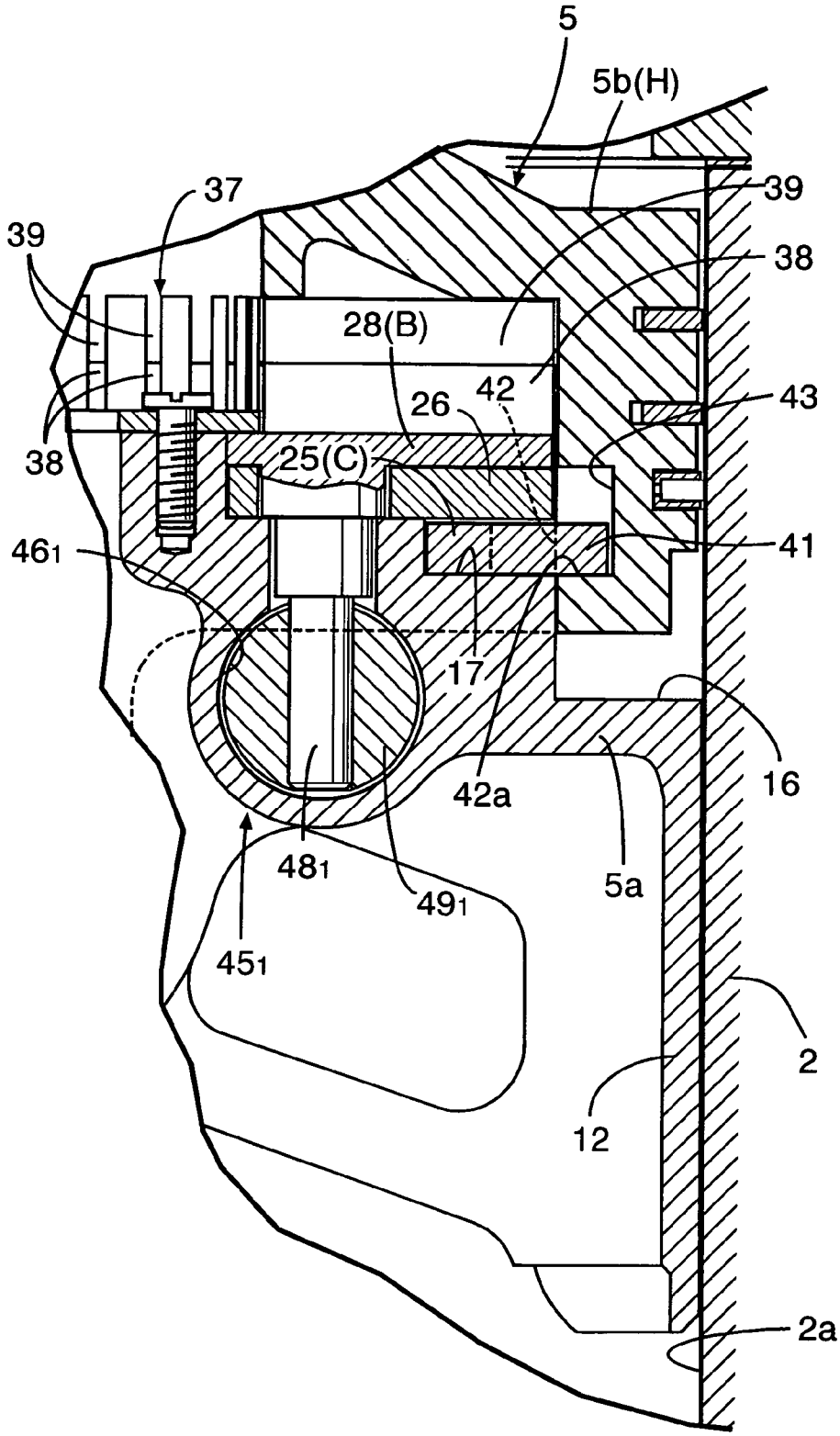
FIG. 23 is a sectional view taken from an arrow of 23-23 line in FIG. 20.

Next, a third embodiment of the present invention will be described with reference to FIGS. 22 and 23.

In the third embodiment, closed portions 42*a* integral with the piston inner part 5*a* are provided in the groove portions of the female spline 42. The closed portions 42*a* receive the tooth portions of the male spline 41 to define the moving limit of the piston outer part 5*b* toward the high compression ratio position H. In this case, in order to secure a reliable abutment by the tooth portions of the male spline 41 onto the close portions 42*a* in the high compression ratio position H of the piston outer part 5*b*, the long holes 14 of the ear parts 13 in the piston outer part 5*b* are formed so that the extension shaft 15 which ascends and descends together with the piston pin 6 does not abut on the lower end walls. Since the other components are the same as those of the first embodiment, components in FIG. 22 corresponding to those of the first embodiment are denoted by the same reference numerals, and the overlapping description thereof will be omitted.

Thus, according to the third embodiment, the moving limit of the piston outer 5*b* toward the high compression ratio position H can be reliably defined by the remarkably simple structure in which the closed portions 42*a* are provided in the groove portions of the male spline 42.

The present invention is not limited to the above described embodiments, and various changes in design can be made to the present invention without departing from the subject matter thereof. For example, the auxiliary switching valve 65 can also be constructed as an electromagnetic type which is turned on and off simultaneously with the electromagnetic type main switching valve 60. In order to define the low compression ratio position L of the piston outer part 5*b*, the lower end surface of the piston outer part 5*b* can be caused to abut on the upper end surfaces 12*a* and 12*a* of the skirt parts 12 of the piston inner part 5*a*. Although the variable compression ratio device of the above described embodiments is of a low-compression-ratio oriented type so as to obtain a low compression ratio state at the non-operating time of the first and the second actuators $\mathbf{45}_1$ and $\mathbf{45}_2$, that is, at the time of retreat of the operation plungers $\mathbf{50}_1$ and $\mathbf{50}_2$ by the urging force of the return springs $\mathbf{55}_1$ and $\mathbf{55}_2$, the variable compression ratio device can be constructed to be of a high-compression-ratio oriented type so as to obtain a high compression ratio state at a non-operating time of the first and the second actuators $\mathbf{45}_1$ and $\mathbf{45}_2$.

Further, although the damping device of the above described embodiments for damping the abutting impact of the extension shaft 15 on the lower end walls of the long holes 14 is of a hydraulic type, the damping device can be constructed to be a mechanical type which elastically receives the extension shaft 15 with an elastic member buried in the lower end wall of the long hole 14, and the above described hydraulic type can be used in combination with this mechanical type.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A variable compression ratio device of an internal combustion engine, comprising:

a piston including a piston inner part connected to a connecting rod via a piston pin, and a piston outer part which is fitted on an outer periphery of the piston inner part so as to be only slidable in an axial direction and which is movable between a low compression ratio position L near the piston inner part and a high compression ratio position H near a combustion chamber, with an outer end surface of the piston outer part facing the combustion chamber, the piston inner part being provided with a piston outer part holding device that selectively holds the piston outer part in the low compression ratio position L and the high compression ratio position H, wherein long holes with longer diameters directed in an axial direction of the piston are provided in the piston outer part to face opposite ends of the piston pin; and a shaft portion connected to the opposite ends of the piston pin is slidably fitted in the long holes to allow an axial relative movement between the piston inner part and the piston outer part while preventing relative rotation between the piston inner part and the piston outer part.

2. The variable compression ratio device of an internal combustion engine according to claim 1, wherein the shaft portion is abutted against lower end walls of the long holes to establish a movement limit of the piston outer part toward the high compression ratio position H.

3. The variable compression ratio device of an internal combustion engine according to claim 1, wherein the long holes are provided in a pair of ear parts extending from a peripheral wall of the piston outer part that receives piston rings so as to face the opposite ends of the piston pin; and a skirt portion slidably guided by an inner peripheral surface of a cylinder bore is formed integrally with the piston inner part and away from the ear parts.

4. The variable compression ratio device of an internal combustion engine according to claim 1, wherein an inner slide flat surface extending in an axial direction of the piston is formed in an outer peripheral surface of the piston inner part; and an outer slide flat surface against which the inner slide flat surface slidably abuts is formed in an inner peripheral surface of the piston outer part.

5. The variable compression ratio device of an internal combustion engine according to claim 3, wherein inner slide flat surfaces extending in an axial direction of the piston are formed in opposite sides of the outer peripheral surface of the piston inner part that face the opposite ends of the piston pin; and outer slide flat surfaces against which the inner slide flat surfaces slidably abut are formed in inner surfaces of the ear parts.

6. The variable compression ratio device of an internal combustion engine according to claim 2, wherein a shock absorber that absorbs an abutment shock of the shaft portion abutting against the lower end walls of the long holes is provided between the shaft portion and the piston inner part.

7. The variable compression ratio device of an internal combustion engine according to claim 1, wherein the piston outer part holding device includes a lift member that is rotatably supported by and coaxially with the piston inner part and is rotatable between a lift release position A in which the piston outer part is movable to the low compression ratio position L, and a lift position B in which the piston outer part is held in the high compression ratio position H.

8. The variable compression ratio device of an internal combustion engine according to claim 2, wherein an escape is provided in an inner end of the lower end wall of each long hole on the side of the center of the piston outer part, the escape preventing the shaft portion from coming into contact with an inner end corner of the lower end wall on the side of the center of the piston outer part when the shaft portion is bent by an abutment shock against the lower end wall.

9. The variable compression ratio device of an internal combustion engine according to claim 8, wherein the lower end wall of each long hole comprises a semicylindrical wall that has one end connected to an outer peripheral surface of the piston outer part and corresponds to a half of a peripheral surface of the shaft portion, and a semi-conical wall that extends from the other end of the semicylindrical wall to an inner peripheral surface of the piston outer part and has a diameter increasing toward the inner peripheral surface; and the semi-conical wall forms the escape.

10. The variable compression ratio device of an internal combustion engine according to claim 2, wherein the long holes are provided in a pair of ear parts extending from a peripheral wall of the piston outer part that receives piston rings so as to face the opposite ends of the piston pin; and a skirt portion slidably guided by an inner peripheral surface of a cylinder bore is formed integrally with the piston inner part and away from the ear parts.

11. The variable compression ratio device of an internal combustion engine according to claim 2, wherein an inner slide flat surface extending in an axial direction of the piston is formed in an outer peripheral surface of the piston inner part; and an outer slide flat surface against which the inner slide flat surface slidably abuts is formed in an inner peripheral surface of the piston outer part.

12. The variable compression ratio device of an internal combustion engine according to claim 2, wherein the piston outer part holding device includes a lift member that is rotatably supported by and coaxially with the piston inner part and is rotatable between a lift release position A in which the piston outer part is movable to the low compression ratio position L, and a lift position B in which the piston outer part is held in the high compression ratio position H.

13. The variable compression ratio device of an internal combustion engine according to claim 3, wherein the piston outer part holding device includes a lift member that is rotatably supported by and coaxially with the piston inner part and is rotatable between a lift release position A in which the piston outer part is movable to the low compression ratio position L, and a lift position B in which the piston outer part is held in the high compression ratio position H.

14. The variable compression ratio device of an internal combustion engine according to claim 4, wherein the piston outer part holding device includes a lift member that is rotatably supported by and coaxially with the piston inner part and is rotatable between a lift release position A in which the piston outer part is movable to the low compression ratio position L, and a lift position B in which the piston outer part is held in the high compression ratio position H.

15. The variable compression ratio device of an internal combustion engine according to claim 5, wherein the piston outer part holding device includes a lift member that is rotatably supported by and coaxially with the piston inner part and is rotatable between a lift release position A in which the piston outer part is movable to the low compression ratio position L, and a lift position B in which the piston outer part is held in the high compression ratio position H.

16. The variable compression ratio device of an internal combustion engine according to claim 6, wherein the piston outer part holding device includes a lift member that is rotatably supported by and coaxially with the piston inner part and is rotatable between a lift release position A in which the piston outer part is movable to the low compression ratio position L, and a lift position B in which the piston outer part is held in the high compression ratio position H.

17. The variable compression ratio device of an internal combustion engine according to claim 3, wherein an escape is provided in an inner end of the lower end wall of each long hole on the side of the center of the piston outer part, the escape preventing the shaft portion from coming into contact with an inner end corner of the lower end wall on the side of the center of the piston outer part when the shaft portion is bent by an abutment shock against the lower end wall.

* * * * *